US007143802B2

(12) United States Patent
Strand et al.

(10) Patent No.: US 7,143,802 B2
(45) Date of Patent: Dec. 5, 2006

(54) CORDLESS BLINDS

(75) Inventors: Toralf H. Strand, Madison, WI (US); Jeff Walker, Middleton, WI (US); James A. Raisbeck, Middleton, WI (US); Christopher J. Malin, Cross Plains, WI (US)

(73) Assignee: Springs Window Fashions LP, Fort Mill, SC (US)

( * ) Notice: Subject to any disclaimer, the term of this patent is extended or adjusted under 35 U.S.C. 154(b) by 303 days.

(21) Appl. No.: 10/634,305

(22) Filed: Aug. 5, 2003

(65) Prior Publication Data

US 2004/0182522 A1 Sep. 23, 2004

Related U.S. Application Data

(63) Continuation-in-part of application No. 10/393,328, filed on Mar. 20, 2003.

(51) Int. Cl.
*A47H 5/14* (2006.01)

(52) U.S. Cl. ..... 160/84.04; 160/84.03; 160/167 R

(58) Field of Classification Search ..... 160/171, 160/170, 167 R, 84.03, 84.01, 84.04, 84.06
See application file for complete search history.

(56) References Cited

U.S. PATENT DOCUMENTS

| | | | | |
|---|---|---|---|---|
| 13,251 | A | 7/1855 | Bixler | |
| 1,756,680 | A | 4/1930 | Dodge | |
| 1,798,869 | A | 3/1931 | Dodge | |
| 1,801,911 | A | 4/1931 | Duncanson | |
| 1,808,455 | A | 6/1931 | Duncanson | |
| 1,845,856 | A | 2/1932 | Ward | |
| 1,894,833 | A * | 1/1933 | Ruby et al. | 160/171 |
| 1,978,152 | A | 10/1934 | Ward | |
| 2,250,106 | A * | 7/1941 | Lorentzen | 160/170 |
| 2,266,160 | A | 12/1941 | Burns | |
| 2,276,716 | A | 3/1942 | Cardona | |
| 2,420,301 | A | 5/1947 | Cusumano | |
| 2,520,629 | A | 8/1950 | Esposito | |
| 2,824,608 | A | 2/1958 | Etten | |
| 3,192,991 | A * | 7/1965 | Anderle | 160/167 R |
| 3,352,349 | A | 11/1967 | Hennequin | |
| 4,326,577 | A | 4/1982 | Tse | |

(Continued)

FOREIGN PATENT DOCUMENTS

EP 1 039 092 A2 9/2000

*Primary Examiner*—David Purol
(74) *Attorney, Agent, or Firm*—Lerner, David, Littenberg, Krumholz & Mentlik, LLP

(57) ABSTRACT

A window blind assembly includes a headrail having a longitudinal axis extending between first and second ends thereof, a first tube rotatably mounted between the first and second ends of the headrail and a second tube rotatably mounted between the first tube and the second end of the headrail. The assembly also has a bottom rail suspended below the headrail, an intermediate rail suspended below the headrail and positioned between the headrail and the bottom rail, and a window covering material extending between the intermediate rail and the headrail, the window covering material having an upper end attached to the intermediate rail and a lower end attached to the bottom rail. The assembly further includes a first lift cord having an upper end secured to the first tube and a lower end secured to the intermediate rail, and a second lift cord having an upper end secured to the second tube and a lower end secured to the bottom rail, whereby the intermediate rail and the bottom rail are movable independently of one another.

27 Claims, 40 Drawing Sheets

U.S. PATENT DOCUMENTS 4,372,432 A 2/1983 Waine et al.
4,574,864 A 3/1986 Tse
4,623,012 A 11/1986 Rude et al.
4,825,929 A * 5/1989 Haines ..... 160/84.06
4,852,627 A 8/1989 Peterson et al.
4,880,045 A 11/1989 Stahler
5,054,162 A 10/1991 Rogers
5,067,541 A 11/1991 Coslett
5,105,867 A 4/1992 Coslett
5,133,399 A 7/1992 Hiller et al.
5,184,660 A 2/1993 Jelic
5,318,090 A 6/1994 Chen
5,328,113 A 7/1994 de Chevron Villette et al.
5,482,100 A 1/1996 Kuhar
5,531,257 A 7/1996 Kuhar
5,628,356 A 5/1997 Marocco
5,706,876 A 1/1998 Lysyj
5,813,447 A 9/1998 Lysyj
RE35,926 E 10/1998 Hagen
5,857,553 A 1/1999 Lagarde et al.
5,960,846 A 10/1999 Lysyj
6,012,506 A 1/2000 Wang et al.
6,024,154 A 2/2000 Wang et al.
6,056,036 A 5/2000 Todd et al.
6,076,587 A 6/2000 Pastor
6,079,471 A 6/2000 Kuhar
6,095,222 A 8/2000 Voss
6,135,189 A * 10/2000 Weinreich ..... 160/191
6,149,094 A 11/2000 Martin et al.
6,158,494 A 12/2000 Huang
6,234,236 B1 5/2001 Kuhar
6,283,192 B1 9/2001 Toti
6,289,965 B1 9/2001 Ruggles
6,330,899 B1 12/2001 Ciuca et al.
6,338,377 B1 * 1/2002 Domel ..... 160/84.02
6,644,373 B1 * 11/2003 Palmer ..... 160/168.1 R
6,662,850 B1 * 12/2003 Chung et al. ..... 160/171

* cited by examiner

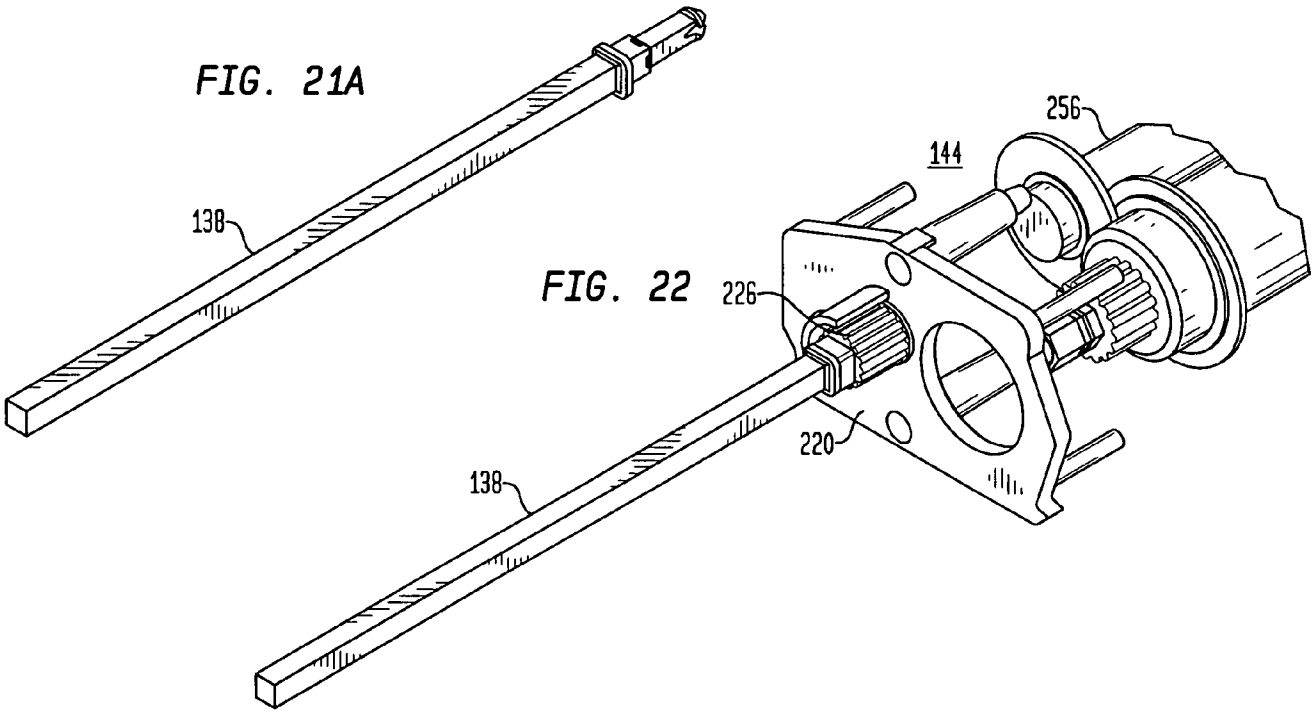
FIG. 21A
FIG. 22
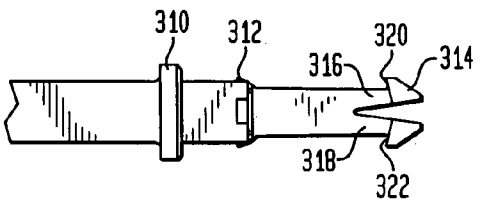
FIG. 21B
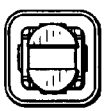
FIG. 21C

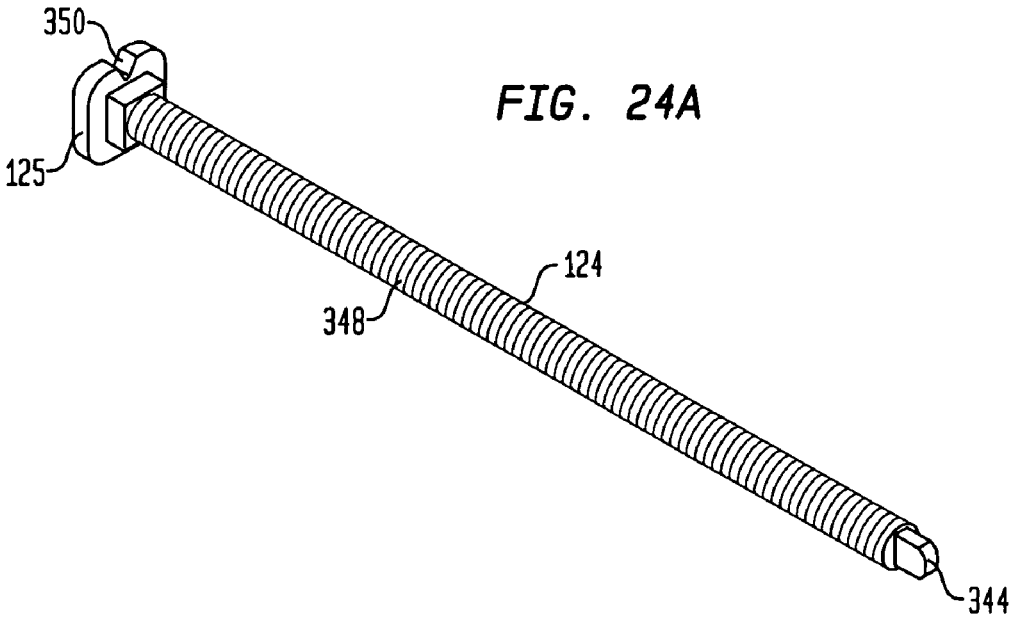
FIG. 24A
FIG. 24B
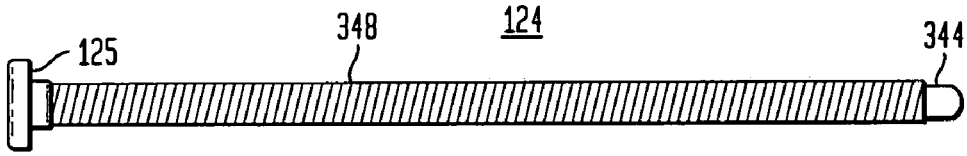
FIG. 24C
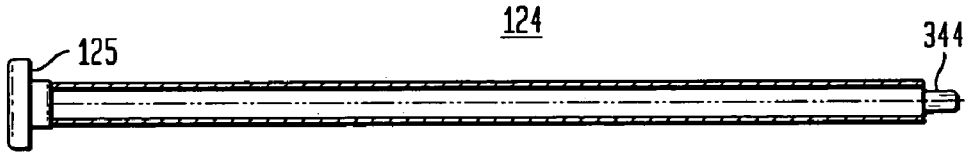
FIG. 24D
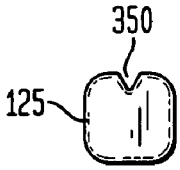

CORDLESS BLINDS

CROSS-REFERENCE TO RELATED APPLICATIONS

The present application is a continuation-in-part of U.S. patent application Ser. No. 10/393,328 filed Mar. 20, 2003.

BACKGROUND OF THE INVENTION

The present application is generally related to window coverings and is more specifically related to cordless blinds for covering window openings.

Window blinds are typically used for covering window openings. The blinds are usually moveable between an open position so that light may pass through the window and a lowered or closed position in which the window blind at least partially blocks the passage of light. A closed window blind also provides privacy so that individuals outside a building may not look into a building. Most window blinds include a lifting cord, which passes through an aperture in each of the slats or through a window covering material such as cellular or pleated shades.

There have been many improvements related to cordless window blinds. Such improvements attempt to simplify the process of operating a window blind and facilitate cleaning of the blind.

For example, U.S. Pat. No. 1,798,869 discloses in FIG. 1 a head rail for a Venetian blind including a traversing rod 16 to which there is attached a pair of lift cords 20, 21. U.S. Pat. No. 1,978,152 discloses a blind incorporating a traversing rod 1 from which there is supported a plurality of slats. Referring to FIG. 6 of the '152 patent, the traversing rod may be operated by a hand crank assembly 23 that is coupled via rod 19 to an end of the traversing rod by means of a gear assembly (FIG. 3).

U.S. Pat. No. 5,318,090 is directed to a roller assembly for a Venetian blind. Referring to FIG. 1 thereof, the roller assembly includes an elongated driving member 62 having a circular axial hole 623 extending through a rectangular shaft section 621. The shaft section is received within the end portion of a rotating rod 50. A guide unit 63 includes a threaded rod 633 extending through the circular axial hole of the driving member and into engagement with a moveable member 61 that is fixed in an intermediate position within the rotating rod. A lift cord is coupled to a portion of the driving member to rotate same in either a clockwise or counterclockwise direction. When the lift cord is pulled, the driving member rotates the rotating rod to move the moveable member along the threaded rod of the guide unit, thereby both rotating and moving the rotating rod along the guide unit.

U.S. Pat. No. RE 35,926 is directed to a Venetian or pleated blind that is adapted to be positioned between a pair of glass panes. Referring to FIGS. 1 and 2 thereof, the blind includes a housing having two corner spacer elements 26, 32 attached to opposite ends of the head rail housing. Each of the corner spacer elements is attached to respective adjacent side spacer elements 60, 62 on each side of the window. The head rail defined by housing elements 4, 8 includes a traversing rod 16 referred to in the claims as a winding shaft.

U.S. Pat. No. 5,482,100 is directed to a blind including at least one constant variable spring force motor having an elongated spring. The spring has a generally rectangular cross-section that varies in width from one end to the other. The varying spring force is sufficient to maintain the bottom rail in any position with respect to the top rail as the shade material accumulates on the bottom rail when moving the bottom rail towards the head rail.

U.S. Pat. No. 5,531,257 is directed to a cordless blind having a spring motor coupled to an electronic motor. The electronic motor and the spring motor rotate a cord spool to raise or lower the window covering.

U.S. Pat. No. 6,234,236 discloses a cordless window covering system incorporating a plurality of spring motors that are coupled together. Referring to the figures, the system includes at least two springs motors 40 in combination with a coupler 62, 62A. The coupler connects the spring motors together to have a combined spring force. In other embodiments, the pair of spring motors are coupled together and attached to the lift cords.

U.S. Pat. No. 6,079,471 teaches a window covering including a friction-imparting member to inhibit movement of the bottom rail. Referring to FIG. 2 thereof, the friction and parting member includes a bracket 55 having a plurality of slots 56 that are used to increase the tension on cord 52 traveling through hole 50 in surface 47 towards the cord spool 30.

U.S. Pat. No. 6,129,131 is generally directed to a blind system including a traversing rod 32 coupled to a pull system 38 that imparts uni-directional movement to the coupling drive shaft 40. The pull system includes a one-way clutch assembly 50 and a main drive assembly 42 including a single pull tape 46 operative of a drive spool 48. The brake arm 150 is adapted to selectively prevent or permit lowering of the shade by gravity. The traversing assembly includes a compression spring 210 having one end slidably engaged with a disc-shaped end 220 of the cord spool 206. The other end of the compression spring is attached to a spring support spool that is rotatable by the drive shaft. The compression spring is relatively light, but strong enough to push the cord spool to the left when no counterforce exists.

Three related patents, U.S. Pat. No. 5,813,447; U.S. Pat. No. 5,960,846 and U.S. Pat. No. 6,047,759 all teach a window shade incorporating an internal spring tensioning mechanism. The spring tensioning mechanism is adapted for tensioning the spring upon rotation of the shade bar in one direction and releasing the spring tension upon opposite shade bar rotation, with the releasing of the spring force accomplished by a manual force rotating the shade bar in the tensioning direction.

Despite the above improvement, there remains a need for improved cordless blind assemblies.

SUMMARY OF THE INVENTION

In accordance with certain preferred embodiments of the present invention, a window blind assembly includes a head rail having a longitudinal axis, a bottom rail suspended below the head rail and a window covering material extending between the head rail and the bottom rail, the window covering material having an upper end attached to the head rail and a lower end attached to the bottom rail. The assembly also preferably includes a traversable tube disposed in the head rail, the traversable tube having first and second ends, and a threaded support rod secured to the head rail adjacent a first end of the tube, the threaded support rod being thread ably coupled with the first end of the tube for providing traversing motion to the tube. A spring motor is desirably secured to the head rail adjacent a second end of the tube, the spring motor is engaged with the second end of the traversable tube for selectively rotating the tube, whereby the drive gears rotate about respective axes that are substantially parallel to the longitudinal axis of the head rail.

In certain preferred embodiments, the spring motor drive gears are coupled together by a timing belt. In further embodiments, a drive shaft has a first end coupled with a pulley and a second end coupled with the traversable tube. A drive plug may be secured in an opening at the second end of the tube, the drive plug having a drive plug opening adapted to slidably receive the second end of the drive shaft. The drive plug opening desirably has a generally square shape, and the drive shaft has a longitudinal axis with a cross-section of the drive shaft perpendicular to the longitudinal axis having a generally square shape.

The assembly may also include a tensioning member positioned on the threaded support rod between the first end of the traversable tube and a first end of the head rail, the tensioning member including a compression spring positioned between two collars so that as the traversable tube is rotated, the tube is displaced longitudinally to engage the tensioning member for compressing the compression spring between the two collars. In operation, the compressed tension member applies an axial load at the first end of the traversing tube for limiting free rotation of the traversing tube.

The assembly preferably includes a lift cord having an upper end secured to the traversing tube and a bottom end secured to the bottom rail. The traversing tube preferably has a longitudinally extending groove and the upper end of the lift cord is captured in the longitudinally extending groove. The assembly preferably includes a C-shaped clip adapted to fit closely over an outer surface of the tube for securing the upper end of the lift cord in the longitudinally extending groove of the tube.

The assembly may also include a cradle mounted in the head rail for supporting rotational and traversing movement of the tube. In certain preferred embodiments, the cradle has at least one opening and the lift cord passes through the at least one cradle opening. In certain preferred embodiments, the cradle may have a pair of opposing sidewalls and a bottom wall, a first opening in one of the sidewalls and a second opening in the bottom wall, whereby the lift cord extends in a first axial direction between the traversing tube and the first lateral sidewall opening, a second axial direction between the first cradle opening and the second cradle opening and a third axial direction between the second cradle opening and the bottom rail.

A first head rail end cap may be secured over a first open end of the head rail, and a second head rail end cap may be secured over a second open end of the head rail. The first head rail end cap desirably has an inner surface defining a slot and the threaded support rod has a head adapted to fit into the slot for securing the threaded support rod to the first head rail end cap.

In certain preferred embodiments, the spring motor includes a threaded anchor post, and a screw is threaded into the anchor post, the screw including a head, whereby the second head rail end cap has an inner surface including a slot and the head of the screw is fit into the slot for securing the spring motor to the second head rail end cap. The spring motor may also include feet adapted to engage the head rail for securing the spring motor to the head rail.

The assembly desirably includes a second lift cord spaced from the first lift cord, the first and second lift cords extending through the window covering material in directions that are generally parallel to one another. The window covering material may be selected from the group consisting of cellular fabric, pleated fabric and slats.

In operation, rotation of the tube causes the lift cord to wind on the tube in a non-overlapping spiral. The window blind assembly is desirably lowered to a closed position by pulling the bottom rail away from the head rail for unwinding the lift cord and rotating the tube as the lift cord unwinds which traverses the tube toward the tensioning member for causing compression of the tensioning member. The spring motor is coupled with the traversing tube and provides a constant tension. The window blind assembly is desirably raised to an open position by lifting the bottom rail toward the head rail for releasing tension from the spring motor, releasing compression of the tensioning member and winding the lift cord around the traversing tube in a non-overlapping spiral as the tube moves back toward the spring motor. As the blind is lowered, the weight of the fabric decreases and the axial force of the compression member increases so as to counteract the decrease in fabric weight.

In certain preferred embodiments, a cradle cover may be secured over the cradle, the cradle cover being adapted to prevent bunching up or looping of the lift cord as the lift cord is rewound on the tube.

In other preferred embodiments, the tensioning member includes a compression spring slid able along the threaded rod between the head of the threaded rod and the threaded plug secured to the first end of the tube, a large diameter collar between the head of the threaded rod and the compression spring, and a small diameter collar between the threaded plug and the compression spring.

Other preferred embodiments of the present invention disclose a window blind assembly including a head rail having a longitudinal axis, a bottom rail suspended below the head rail, a window covering material extending between the head rail and the bottom rail, the window covering material having an upper end attached to the head rail and a lower end attached to the bottom rail, and a traversable tube mounted in the head rail, the tube having first and second ends and extending in a direction substantially parallel to the longitudinal axis of the head rail. The assembly also desirably includes a threaded support rod secured to the head rail adjacent the first end of the tube, the threaded support rod being thread ably coupled with the first end of the tube for providing traversing motion to the tube along the longitudinal axis of the head rail, and a spring motor secured to the head rail adjacent the second end of the tube, the spring motor having drive gears in communication with the second end of the tube for selectively rotating the tube. The spring motor desirably includes a storage drum, an output drum and an elongated spring connected to the storage and output drums, whereby the storage and output drums rotate along respective axes that are substantially parallel to the longitudinal axis of the head rail.

The assembly may also include a drive shaft having a first end coupled with the spring motor drive gears and a second end coupled with the second end of the traversing tube, whereby rotation of the tube causes rotation of the drive shaft, which in turn rotates the spring motor drive gears.

In certain preferred embodiments, the spring motor includes a first power plate having first and second circular openings and a second power plate having first and second openings, the first and second power plates having opposing posts for assembling the first and second power plates together so that the respective first openings of the assembled power plates are aligned with one another and the respective second openings of the assembled power plates are aligned with one another. The storage drum desirably has bearing surfaces on opposite ends thereof enjoyable with the first openings of the assembled power plates for supporting rotation of the storage drum, and wherein the output drum has bearing surfaces on opposite ends thereof enjoyable with the second openings of the assembled power plates for supporting rotation of the output drum.

In other preferred embodiments, the first power plate has an exterior surface including a stub shaft and the output drum includes one of the drive gears integrally formed therewith, the one of the drive gears passing through the second opening of the first power plate. The assembly may also include a pulley rotatably mounted over the stub shaft of the first power plate, a timing belt coupling the pulley and the one of the drive gears passing through the second opening of the first power plate, and a retainer ring mounted over an outer end of the one of the drive gears passing through the second opening of the first power plate for retaining the timing belt on the one of the drive gears passing through the second opening of the first power plate. The retainer ring desirably has a flat surface and an opposite curved surface, the curved surface of the retainer ring desirably facing the timing belt.

In other preferred embodiments, the first end of the drive shaft is coupled with the pulley. The first end of the drive shaft may have a generally square shaped cross section and the pulley may have a generally square shaped opening adapted to receive the first end of the drive shaft.

In other preferred embodiments, a window blind assembly includes a headrail having a longitudinal axis, a bottom rail suspended below the headrail and a window covering material extending between the headrail and the bottom rail, the window covering material having an upper end attached to the headrail and a lower end attached to the bottom rail. The assembly also desirably includes a traversable tube disposed in the headrail, the traversable tube having first and second ends, and a threaded support rod secured to the headrail adjacent a first end of the tube, the threaded support rod being threadably coupled with the first end of the tube for providing traversing motion to the tube along the longitudinal axis of the headrail. The assembly also preferably includes a spring motor secured to the headrail adjacent a second end of the tube, the spring motor having drive gears in communication with the second end of the traversable tube for selectively rotating the tube and a tensioning member positioned on the threaded support rod between the first end of the traversable tube and an end of the headrail, the tensioning member including a compression spring positioned between two collars, whereby as the traversable tube is rotated, the tube is displaced along the longitudinal axis of the headrail and away from the spring motor so that the tube engages the tensioning member for compressing the compression spring between the two collars. The compressed tensioning member desirably applies an axial load on the first end of the traversable tube for limiting free rotation of the traversable tube.

In other preferred embodiments, the spring motor drive gears are coupled together using a timing belt, and the assembly further includes a drive shaft having a first end coupled with one of the spring motor drive gears and a second end coupled with the traversable tube. The spring motor may include a first power plate having first and second circular openings, and a second power plate having first and second openings, the first and second power plates having opposing posts for assembling the first and second power plates together so that the respective first openings of the assembled power plates are aligned with one another and the respective second openings of the assembled power plates are aligned with one another.

In other preferred embodiments, a storage drum having bearing surfaces on opposite ends thereof is engagable with the first openings of the power plates for supporting rotation of the storage drum and an output drum having bearing surfaces on opposite ends thereof is engagable with the second openings of the power plates for supporting rotation of the output drum. The first power plate desirably has an exterior surface including a stub shaft and the output drum includes one of the drive gears integrally formed therewith, the one of the drive gears passing through the second opening of the first power plate.

In accordance with another preferred embodiment of the present invention, a window blind assembly includes a headrail having a longitudinal axis extending between first and second ends thereof, a first tube rotatably mounted between the first and second ends of the headrail, and a second tube rotatably mounted between the first tube and the second end of the headrail. The assembly also includes a bottom rail suspended below the headrail, an intermediate rail suspended below the headrail and positioned between the headrail and the bottom rail and window covering material extending between the intermediate rail and the headrail. A first lift cord preferably has an upper end secured to the first tube and a lower end secured to the intermediate rail. A second lift cord preferably has an upper end secured to the second tube and a lower end secured to the bottom rail. The intermediate rail and the bottom rail are desirably moveable independently of one another. The window covering material preferably has an upper end attached to the intermediate rail and a lower end attached to the bottom rail. In other preferred embodiments, the assembly may include a second window covering material extending between the headrail and the intermediate rail. The second window covering material may have a different opacity, color and/or texture than the first window covering material. The second window covering material may have an upper end attached to the head rail and a lower end attached to the intermediate rail.

In certain preferred embodiments, the window blind assembly includes a first guide connected to the headrail and adapted to direct the first lift cord through a path including a first leg extending away from the first tube, a second leg extending away from the first tube and toward the second tube, and a third leg extending away from the second tube and toward the intermediate rail. The first leg of the first lift cord desirably extends in a direction generally perpendicular to the longitudinal axis of the headrail, the second leg of the first lift cord desirably extends in a direction generally parallel to the longitudinal axis of the headrail, and the third leg of the first lift cord desirably extends in a direction generally perpendicular to the longitudinal axis of the headrail. The assembly also desirably includes a second guide connected with the headrail and adapted to direct the second lift cord through a path including a first leg extending away from the second tube, a second leg extending away from the second tube and toward the first tube, and a third leg extending away from the first tube and toward the bottom rail. In a similar fashion, the first leg of the second lift cord desirably extends in a direction generally perpendicular to the longitudinal axis of the headrail, the second leg of the second lift cord desirably extends in a direction generally parallel to the longitudinal axis of the headrail, and the third leg of the second lift cord desirably extends in a direction generally perpendicular to the longitudinal axis of the headrail. In certain preferred embodiments, the first and second guides are integrated into an insert rail that is connected to the headrail. In more preferred embodiments, the insert rail is connected to an underside of the headrail. The guides may be a combination of window openings formed in the cradles and cord guide/eyelets inserted into the window covering material. The assembly also desirably includes a third lift cord having an upper end secured to the first tube and a lower end secured to the intermediate rail, and a fourth lift cord having an upper end secured to the second tube and a lower end secured to the bottom rail.

In certain preferred embodiments, a first threaded support rod is disposed in the headrail and is threadably coupled with an end of the first tube and a first spring motor is disposed in the headrail and is coupled with the first tube for driving the first tube. The assembly also desirably includes a second threaded support rail disposed in the headrail and threadably coupled with an end of the second tube and a second spring motor disposed in the headrail and coupled with the second tube for driving the second tube. The first and second tubes are rotatably mounted in the headrail and preferably traverse between first and second ends of the headrail when being driven by the respective first and second spring motors. The first and second tubes desirably rotate and traverse independently of one another.

The assembly may also include a tensioning member positioned on the first threaded support rod and being engagable with an end of the first tube, the tensioning member including a compression spring positioned between two collars. When the first tube is rotated, the first tube is displaced longitudinally along the longitudinal axis of the headrail, whereby the end of the first tube engages the tensioning member so that the compression spring is compressed between the two collars. A second tensioning member may be supplied on the second threaded support rod for engaging an end of the second tube.

In other preferred embodiments of the present invention, a window blind assembly includes a headrail having a longitudinal axis extending between first and second ends thereof, a tube rotatably mounted between the first and second ends of the headrail, and a bottom rail suspended below the headrail by first and second lift cords. The window blind assembly also desirably includes a window covering material extending between the headrail and the bottom rail. The window covering material may have an upper end attached to the headrail and a lower end attached to the bottom rail. The assembly also desirably includes a first guide connected to the headrail, whereby the first guide is adapted to direct the first lift cord through a path including a first leg extending away from the tube, a second leg extending away from a first end of the tube and toward a second end of the tube, and a third leg extending away from the tube and toward the bottom rail. The assembly also preferably includes a second guide connected to the headrail and being adapted to direct the second lift cord through a path including a first leg extending away from the tube, a second leg extending away from the second end of the tube and toward the first end of the tube, and a third leg extending away from the tube and toward the bottom rail. In preferred embodiments, the first lift cord is secured to the tube adjacent the first end of the tube and the second lift cord is secured to the tube adjacent the second end of the tube. The assembly also preferably comprises a threaded support rod disposed in the headrail adjacent one of the ends of the headrail, the threaded support rod being threadably coupled with one of the ends of the tube. The assembly also desirably includes a spring motor disposed in the headrail and being coupled with a tube for driving the tube, whereby the tube traverses between the first and second ends of the headrail when being driven by the spring motor. In certain preferred embodiments, the threaded support rod is disposed adjacent the first end of the headrail and is threadably coupled with the first end of the tube and the spring motor is disposed adjacent the second end of the headrail and is coupled with the second end of the tube.

The assembly may also include a tensioning member positioned on the first threaded support rod between one of the ends of the headrail and one of the ends of the tube, the tensioning member including a compression spring positioned between two collars so that as the tube is rotated, the tube is displaced longitudinally to engage the tensioning member whereby the compression spring is compressed between the two collars.

In other preferred embodiments, a window blind assembly includes a headrail having a longitudinal axis extending between first and second ends thereof, a first tube rotatably mounted between the first and second ends of the headrail and a second tube rotatably mounted between the first tube and the second end of the headrail, whereby the first and second tubes rotate independently of one another. The assembly also desirably includes a bottom rail suspended below the headrail by lift cords, and a window covering material extending between the headrail and the bottom rail. The lift cords desirably include a first lift cord having an upper end secured to the first tube and a lower end secured to the bottom rail and a second lift cord having an upper end secured to the second tube and a lower end secured to the bottom rail. The assembly may also include a third lift cord having an upper end secured to the first tube and a lower end secured to the bottom rail and a fourth lift cord having an upper end secured to the second tube and a lower end secured to the bottom rail. The assembly desirably includes a first guide connected to the headrail and being adapted to direct the first lift cord through a path including a first leg extending away from the first tube, a second leg extending away from the first tube and toward the second tube and a third leg extending away from the second tube and toward the bottom rail. The assembly also desirably includes a second guide connected to the headrail and being adapted to direct the second lift cord through a path including a first leg extending away from the second tube, a second leg extending away from the second tube and toward the first tube and a third leg extending away from the first tube and toward the bottom rail. The guides may be a combination of an insert rail having eyelets formed therein and window openings in the cradles. The guides may also be a combination of the window openings formed in the cradles and eyelets or cord guides inserted in the window covering material adjacent an upper end of the window covering material, whereby the upper end of the window covering material is secured to the headrail. In preferred embodiments, the first leg of the first lift cord desirably extends in a direction generally perpendicular to the longitudinal axis of the headrail, the second leg of the first lift cord desirably extends in a direction generally parallel to the longitudinal axis of the headrail, and the third leg of the first lift cord desirably extends in a direction generally perpendicular to the longitudinal axis of the headrail. The second lift cord desirably has a first leg that extends in a direction generally perpendicular to the longitudinal axis of the headrail, a second leg that extends in a direction generally parallel to the longitudinal axis of the headrail, and a third leg that extends in a direction generally perpendicular to the longitudinal axis of the headrail. In highly preferred embodiments, the first and second guides are integrated into an insert rail secured to the headrail. In other preferred embodiments, the window covering material is secured to the headrail and the first and second guides are integrated into the window covering material. In this latter embodiment the guides are eyelets or cord guides attached to or inserted into the window covering material.

The assembly may also include a third lift cord extending between the first tube and the bottom rail in a direction substantially perpendicular to the longitudinal axis of the headrail, and a fourth lift cord extending between the second tube and the bottom rail in a direction substantially perpendicular to the longitudinal axis of the headrail. The third lift cord desirably has an upper end connected to the first tube and a lower end connected to the bottom rail. The fourth lift cord desirably has an upper end connected to the first tube and a lower end connected to the bottom rail.

The assembly also desirably includes a first threaded support rod disposed in the headrail and threadably coupled with the first tube for providing traversing movement with the first tube and a second threaded support rod disposed in the headrail threadably coupled with the second tube for providing traversing movement to the second tube, whereby the first and second tubes are moveable independently of one another between the first and second ends of the headrail. The assembly also preferably includes a first spring motor disposed in the headrail and coupled with the first tube for driving the first tube, whereby the first tube traverses between the first and second ends of the headrail when being driven by the first spring motor, and a second spring motor disposed in the headrail and coupled with the second tube for driving the second tube, whereby the second tube traverses between the first and second ends of the headrail when being driven by the second spring motor. In certain preferred embodiments, the first and second spring motors include drive gears that rotate about axes that are substantially parallel to the longitudinal axis of the headrail.

In still other preferred embodiments of the present invention, a window blind assembly includes a headrail having a longitudinal axis extending between first and second ends thereof, a first tube rotatably mounted between the first and second ends of the headrail and a second tube rotatably mounted between the first tube and the second end of the headrail, whereby the first and second tubes rotate and traverse independently of one another. The assembly also preferably includes a first bottom rail suspended below the headrail by a first lift cord, a first window covering material extending between the headrail and the first bottom rail, a second bottom rail suspended below the headrail by a second lift cord and a second window covering material extending between the headrail and the second bottom rail. The assembly also desirably includes a first lift cord having an upper end secured to the first tube and a lower end secured to the first bottom rail and a second lift cord having a upper end secured to the second tube and the lower end secured to the second bottom rail. In certain preferred embodiments, the first window covering material has an upper end attached to the headrail and a lower end attached to the first bottom rail and the second window covering material has an upper end attached to the headrail and a lower end attached to the second bottom rail. The first and second window covering materials may have a different opacity, color and/or texture.

In another preferred embodiment of the present invention, a window blind assembly includes a headrail having a longitudinal axis extending between first and second ends thereof, a tube rotatably mounted between the first and second ends of the headrail, a bottom rail suspended below the headrail, and an intermediate rail suspended below the headrail in a position between the headrail and the bottom rail. The assembly also desirably includes a window covering material extending between the intermediate rail and the bottom rail and a lift cord having an upper end secured to the tube and a lower end secured to the intermediate rail. The assembly also desirably includes a second tube rotatably mounted between the first and second ends of the headrail, and a second lift cord having an upper end secured to the second tube and a lower end secured to the bottom rail, whereby the first and second tubes rotate independently of one another. The assembly also desirably includes a first guide connected with the headrail and adapted to direct the first lift cord through a path including a first leg extending away from the first tube, a second leg extending away from the first tube and toward the second tube, and a third leg extending away from the second tube and toward the intermediate rail. The assembly also preferably includes a second guide connected with the headrail and adapted to direct the second lift cord through a path including a first leg extending away from the second tube, a second leg extending away from the second tube and toward the first tube, and a third leg extending away from the first tube and toward the bottom rail. The first and second guides are desirably integrated into an insert rail that may be connected to an underside of the headrail. The assembly also desirably includes a third lift cord having an upper end secured to the first tube and a lower end secured to the intermediate rail and a fourth lift cord having an upper end secured to the second tube and a lower end secured to the bottom rail.

The assembly preferably includes a first threaded support rod disposed in the headrail and threadably coupled with an end of the first tube and a first spring motor disposed in the headrail and coupled with the first tube for driving the first tube, whereby the first tube traverses between the first and second ends of the headrail when being driven by the first spring motor. The assembly preferably includes a second threaded support rod disposed in the headrail and threadably coupled with an end of the second tube and a second spring motor disposed in the headrail and coupled with the second tube for driving the second tube, whereby the second tube traverses between the first and second ends of the headrail when being driven by the second spring motor.

In further preferred embodiments of the present invention, a cordless window blind assembly has a combined tilt and lift control. The assembly desirably includes a headrail having a longitudinal axis extending between first and second ends thereof, a bottom rail suspended below the headrail, and slats extending between the headrail and the bottom rail. The assembly also desirably includes a motor, such as a spring motor, mounted in the headrail and a tube rotatably mounted between the first and second ends of the headrail and coupled with the motor. The assembly also preferably includes a lift cord having an upper end secured to the rotatable tube and a lower end secured to the bottom rail. A ladder tape is desirably suspended below the headrail and connected with the slats, the ladder tape including a front ladder cord extending below a front section of the headrail and a rear ladder cord extending below a rear section of the headrail, the front ladder cord entering the headrail, at least partially wrapping around the tube and exiting the headrail for connection with the rear ladder cord at a location outside the headrail. Lowering the bottom rail relative to the head rail causes rotation of the tube in a direction for simultaneously unwinding the lift cord from the tube and actuating the ladder tape for rotating the slats until the slats are rotated into a closed position whereupon the front ladder cord at least partially wrapped around the tube will slip relative to the tube as the tube continues to rotate. Raising the bottom rail relative to the head rail causes rotation of the tube in an opposite direction for simultaneously winding the lift cord about the tube and actuating the ladder tape for rotating the slats in an opposite direction until the slats are rotated to an open position, whereupon the front ladder cord at least partially wrapped around the tube will slip relative to the tube as the tube continues to rotate.

The assembly preferably includes a second lift cord having an upper end secured to the rotatable tube and a lower end secured to the bottom rail, the second lift cord spaced from the first lift cord, and a second ladder tape suspended below the headrail and connected with the slats, the second ladder tape including a front ladder cord extending below a front section of the headrail and a rear ladder cord extending below a rear section of the headrail, the front ladder cord of the second ladder tape entering the headrail, at least partially wrapping around the tube and exiting the headrail for connection with the rear ladder cord of the second ladder tape at a location outside the headrail, wherein lowering the bottom rail relative to the head rail causes rotation of the tube for simultaneously unwinding the first and second lift cords from the tube and actuating the first and second ladder tapes for rotating the slats until the slats are rotated to the closed position, whereupon the front ladder cords at least partially wrapped around the tube will slip relative to the tube as the tube continues to rotate.

In other preferred embodiments of the present invention, a cordless window blind assembly having a combined tilt and lift control includes a headrail having a longitudinal axis extending between first and second ends thereof, a bottom rail suspended below the headrail, and slats extending between the headrail and the bottom rail. The assembly desirably includes a motor mounted in the headrail, a tube rotatably mounted between the first and second ends of the headrail and coupled with the motor, a lift cord having an upper end secured to the tube and a lower end secured to the bottom rail and a ladder tape suspended below the headrail and connected with the slats. The ladder tape may include a ladder cord wound around the tube, whereby lowering the bottom rail relative to the head rail causes rotation of the tube for simultaneously unwinding the lift cord from the tube and actuating the ladder tape for rotating the slats.

The assembly may also include a second lift cord having an upper end secured to the tube and a lower end secured to the bottom rail, the second lift cord being spaced from the first lift cord. The assembly may also include a second ladder tape suspended below the headrail and connected with the slats, the second ladder tape including a ladder cord wound around the tube, wherein lowering the bottom rail relative to the head rail causes rotation of the tube for simultaneously unwinding the first and second lift cords from the tube and actuating the ladder tapes for rotating the slats. The ladder tapes are preferably adapted to slip relative to the tube after the slats are rotated to a first closed position and the tube continues to rotate for unwinding the lift cords. In contrast, raising the bottom rail relative to the head rail causes rotation of the tube for simultaneously winding the first and second lift cords about the tube and actuating the ladder tapes for rotating the slats in series to an open position and then to a second closed position. In certain preferred embodiments, the slats are rotated approximately 150–180 degrees when moving between the closed position and the second closed position.

These and other preferred embodiments of the present invention will be described in more detail below.

BRIEF DESCRIPTION OF THE DRAWINGS

FIGS. 21A–21C show the drive shaft of FIG. 20.

FIG. 22 shows the drive shaft of FIGS. 21A–21C connected with the spring motor of FIG. 15A.

FIGS. 24A–24D show a threaded support rod for the cordless blind assembly of FIG. 1.

DETAILED DESCRIPTION

Figure 1A:
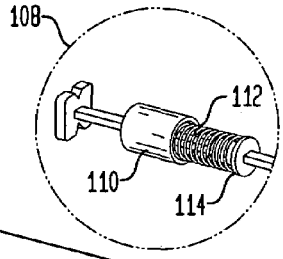
FIG. 1 shows an exploded view of a cordless blind assembly, in accordance with certain preferred embodiments of the present invention.
Figure 1:
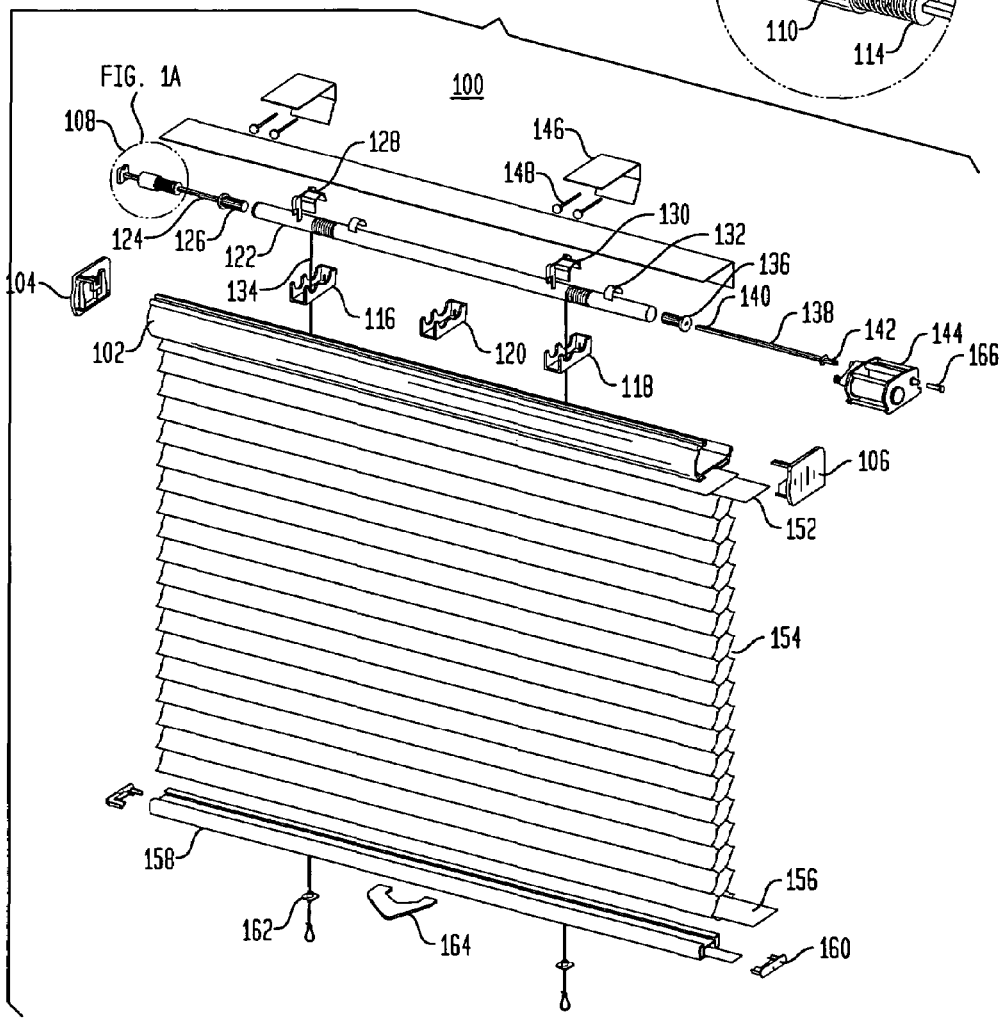

FIG. 1 shows an exploded view of a cordless blind assembly, in accordance with certain preferred embodiments of the present invention. The assembly includes a headrail 102, a left hand headrail end cap 104 and a right hand headrail end cap 106. The left hand and right hand end caps 104, 106 cover the respective left and right ends of headrail 102. The assembly also preferably includes a tensioning member 108 including a large diameter collar 110, a compression spring 112 and a small diameter collar 114.

The cordless blind assembly 100 desirably includes a first cradle 116 and a second cradle 118 assembled with headrail 102. The assembly 100 also includes a central cradle 120. In certain preferred embodiments, however, the central cradle 120 is not required. The first and second cradles 116, 118 are adapted to support rotational and traversing movement of tube 122. The cellular shade 100 also includes threaded rod 124 and threaded plug 126 insert able into an opening at a first end of tube 122. Cordless blind assembly 100 also includes a first cradle cover 128 for assembly with first cradle 116 and a second cradle cover 130 for assembly with second cradle 118. Although not limited by any particular theory of operation, it is believed that, if the blind is raised slightly off-center, the cradle covers 128, 130 prevent lift cord slack from developing on one side of tube 122 as opposed to the other side of tube 122.

The cordless blind assembly 100 also includes clips 132 attachable over the outer surface of tube 122 for holding ends of lift cord 134 in place.

The assembly 100 also includes a drive plug 136 insert able into an opening at a second end of tube 122, and a drive shaft having 138 having a first end 140 adapted to engage an opening in drive plug 136. Drive shaft 138 has a second end 142 engagable with a power assembly 144, such as a spring motor. The drive shaft is adapted to translate rotational movement to the drive plug, however, the drive plug is able to slide along the drive shaft to facilitate traversing movement of tube 122.

The cordless blind assembly 100 also preferably includes a mounting bracket 146 and mounting screws 148 for mounting the headrail 102 over a window opening. The assembly 100 also preferably includes a dust cover 150 adapted to cover the upper side headrail 102, as well as the traversing tube 120 and power assembly 144 disposed within headrail 102. The assembly 100 also includes a slat 152 assembled with an underside of headrail 102. The slat 152 engages an upper end of a window covering material 154, such as cellular fabric for attaching the window covering material 154 with headrail 102. The assembly 100 includes a second slat 156 inserted into the bottommost cell of window covering material 154. The second slat 156 engages an upper face of bottom rail 158 for connecting bottom rail 158 with the window covering material 154. The bottom rail 158 includes openings at both ends adapted to receive bottom rail end caps 160. The lift cord 134 has a lower end that is passed through window covering material 154, bottom rail 158 and washer 162 for tying off the bottom end of lift cord 134 and securing the bottom end against an underside of bottom rail 158. The assembly also includes a handle 164 attached to bottom rail 158.

Referring to FIG. 1, the cordless blind assembly 100 also includes a screw 166 connectable with the power assembly 144. The screw 166 includes a head shaped to engage a notch formed in right hand headrail end cap 106, so as to reliably secure power assembly 144 to headrail 102 and right hand headrail end cap 106.

Figure 2A:
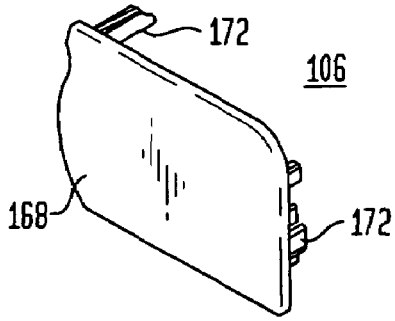
FIGS. 2A–2C show a right hand headrail end cap for the assembly of FIG. 1.
Figure 2B:
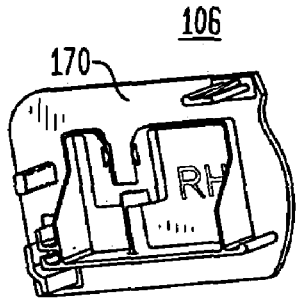
Figure 2C:
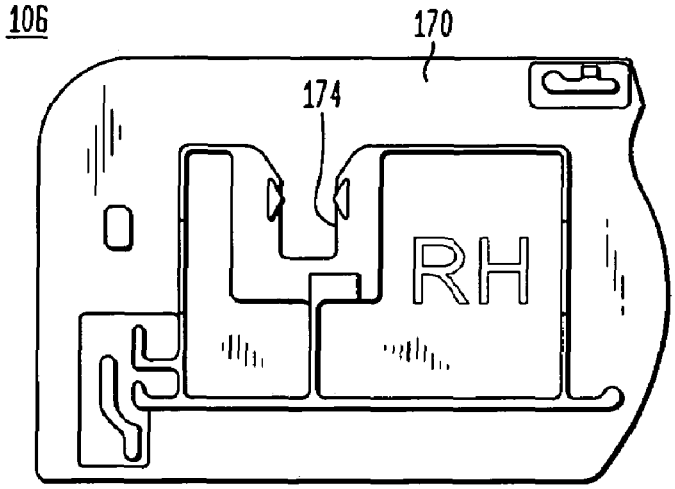

FIGS. 2A–2C show right hand headrail end cap 106 including outer face 168, inner face 170 and projections 172 engagable with slots formed at an end of the headrail shown in FIG. 1. The inner face 170 of right hand headrail end cap 106 includes a notch 174 adapted to receive and secure a head of screw 166 (FIG. 1), which in turn secures the power assembly 144 to the headrail 102 (FIG. 1).

Figure 3A:
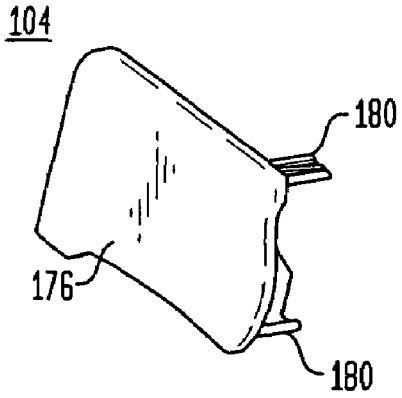
FIGS. 3A–3C show a left hand headrail end cap for the assembly of FIG. 1.
Figure 3B:
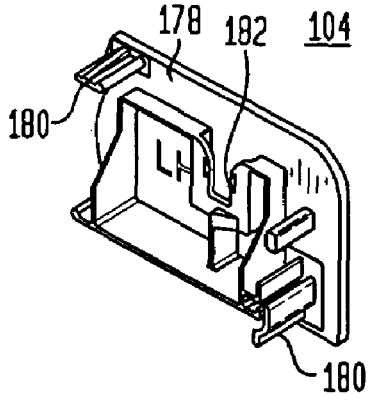
Figure 3C:
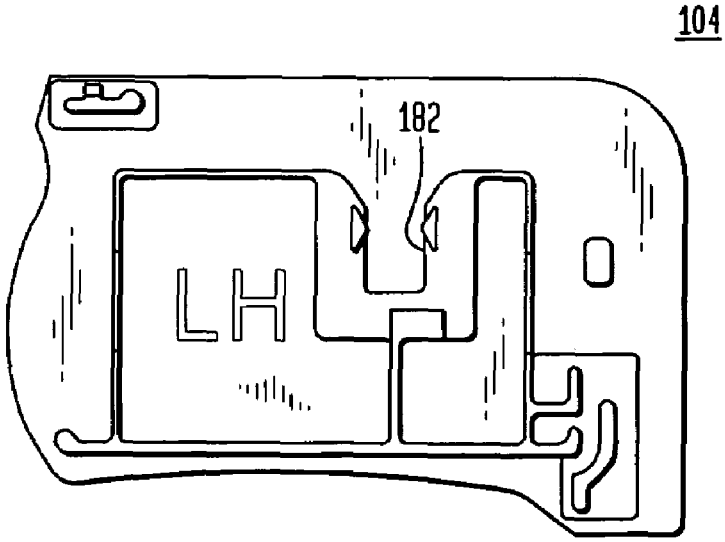

FIG. 3A shows the left hand headrail end cap 104 of FIG. 1 including outer face 176, inner face 178 and projections 180 extending from inner face 178. The projections 180 are adapted to engage slots formed in a left hand side of the headrail 102 of FIG. 1. Referring to FIGS. 3B and 3C, the left hand headrail end cap 104 includes a notch 182 adapted to receive an end of threaded rod 124 (FIG. 1).

Figure 4:
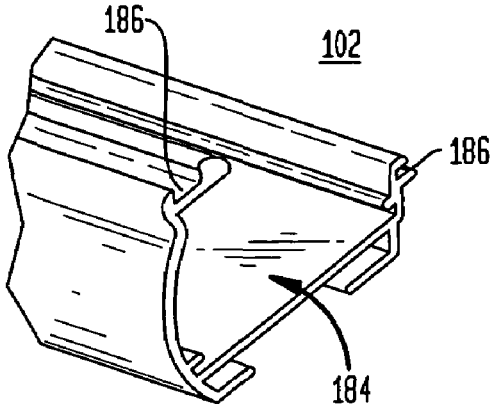
FIG. 4 shows a perspective end view of a headrail for the assembly of FIG. 1.

FIG. 4 shows an end view of headrail 102 including an opening 184 having slots 186 formed therein adapted to receive the projections 172 of right hand headrail end cap 106.

Figure 5:
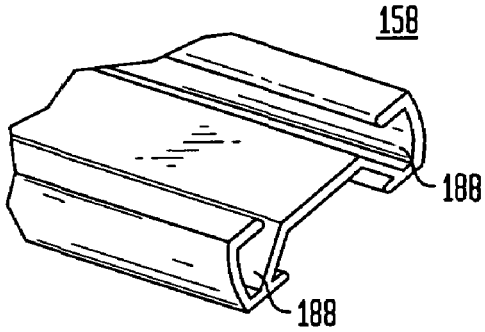
FIG. 5 shows a perspective end view of a bottom rail for the assembly of FIG. 1.
Figure 6:
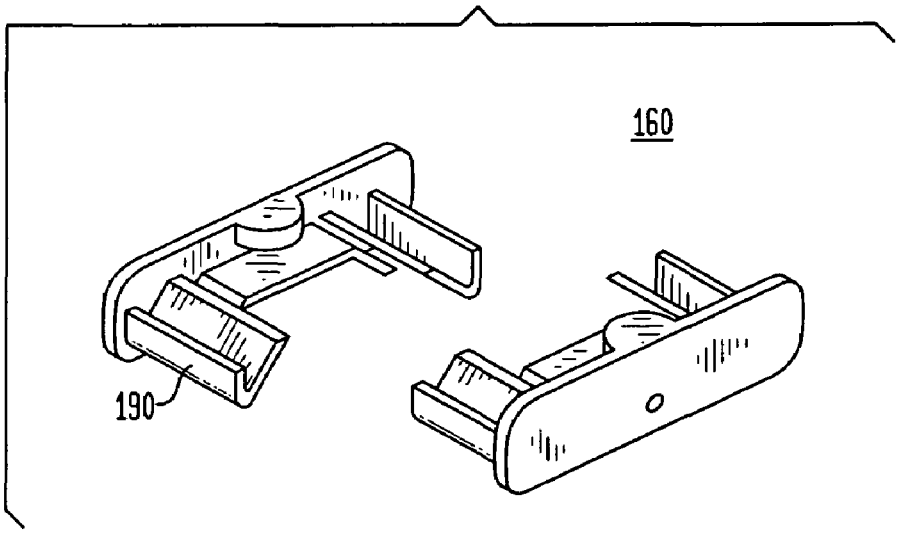
FIG. 6 shows end caps for the bottom rail of FIG. 5.

FIG. 5 shows an end view of bottom rail 158 including slots 188 formed therein. Referring to FIG. 6, the assembly includes bottom rail end caps 160. Each bottom rail end cap 160 has projections 190 adapted to be inserted into the slots 188 of bottom rail 158.

Figure 7:
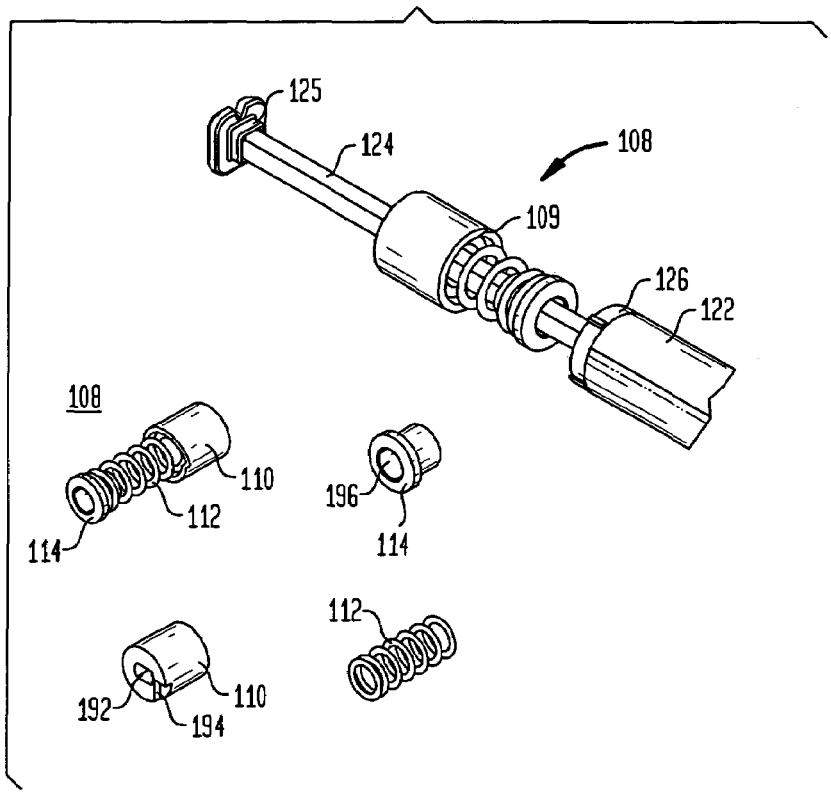
FIG. 7 shows a perspective view of a tensioning member for the assembly of FIG. 1, in accordance with certain preferred embodiments of the present invention.

Referring to FIG. 7, a tensioning member 108 is inserted between a headrail end cap (not shown) and the end of tube 122 remote from power assembly 144 (FIG. 1). The tube 122 has an opening at an end thereof adapted to receive threaded plug 126. The threaded plug includes a central threaded opening 190 (FIG. 8B) adapted to receive threaded rod 124 having a head 125. The periphery of threaded plug 126 has projections 127 adapted to engage internal notch 109 of large diameter collar 110. The tensioning member is assembled about the exterior of threaded rod 124. Tensioning member 108 includes large diameter collar 110, small diameter collar 114 and compression spring 112 assembled between collars 110, 114. The compression spring 112 is wound about threaded rod 124. Although not limited by any particular theory of operation, it is believed that the tensioning member will place more holding force on the tube 122 as the bottom rail and the cellular fabric 154 are lowered down over the window opening. As the cellular fabric 154 is pulled down, the tube 122 will rotate for unwinding the lift cords and traverse to the left.

Referring to FIG. 7A, in certain preferred embodiments, the tensioning member 108 includes a large diameter collar 110, a small diameter collar 114 and a compression spring 112 assembled therebetween. The large diameter collar 110 includes a central opening 192 extending there through for receiving threaded rod 124 of FIG. 7. The larger diameter tubular cover 110 also includes an outer notch 194 formed at an end thereof adapted to engage head 125 of threaded rod 124 and an inner notch 109. The tensioning member 108 also includes the small diameter collar 114 having a central opening 196 adapted to receive threaded rod 124 (FIG. 7). The compression spring 112 is preferably a helically wound compression spring.

Figure 8A:
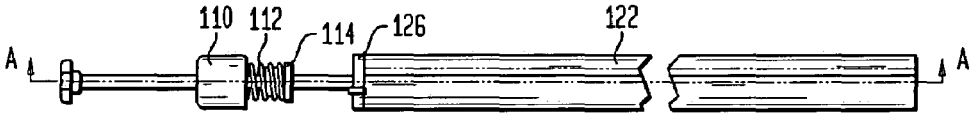
FIG. 8A shows a side view of the tensioning member of FIG. 7, in accordance with further preferred embodiments of the present invention.
Figure 8B:
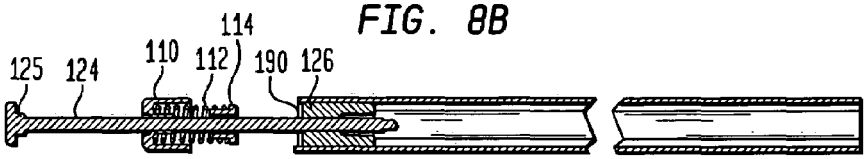
FIG. 8B shows a cross-sectional view of the tensioning member of FIG. 7 in a non-compressed position.
Figure 8C:
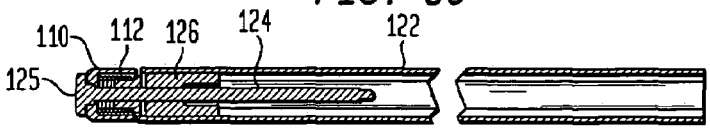
FIG. 8C shows the tensioning member of FIG. 8B in a compressed position.

FIG. 8B shows tensioning member in an uncompressed position. As tube 122 traverses to the left, the threaded plug 126 of tube 122 engages small diameter collar 114 for compression spring 112 between large diameter collar 110 and small diameter collar 114. Although not shown in FIGS. 8B and 8C, the outer end of large diameter collar includes a notch 194 that engages head 125 of threaded rod 124 for preventing rotational movement of large diameter collar 110. The increasing force provided by the compression spring 112 increases the axial force at the end of the tube 122 for resisting axial movement of tube 122.

Figure 9A:
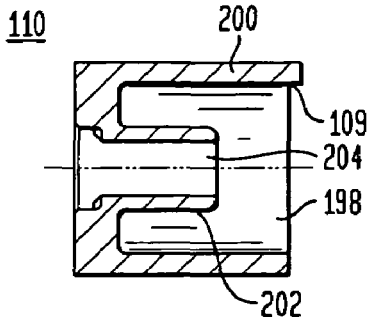
FIGS. 9A–9C show a large diameter collar for the tensioning member of FIG. 7.
Figure 9B:
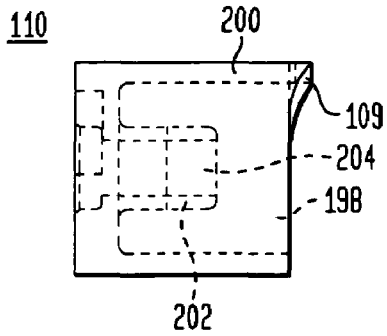
Figure 9C:
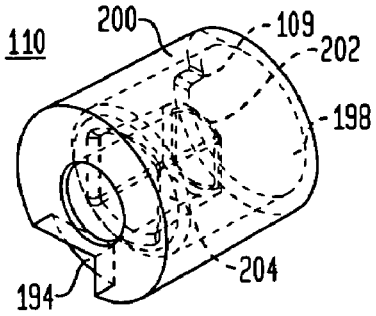

Referring to FIGS. 9A–9C, large diameter collar 110 includes an opening 198 sized to receive the compression spring 112 (FIG. 8), an outer wall 200 defining the central opening 198 and a central hub 202. The central hub 202 includes a central bore 204 adapted to receive threaded rod 124, so that threaded rod 124 (FIG. 1) may pass there through. The large diameter collar 110 also includes an outer notch 194 and an inner notch 109. During compression of the tensioning member, the outer notch 194 engages the end cap and the inner notch 109 engages the end of tube 122 for preventing rotation of the tensioning member.

Figure 10A:
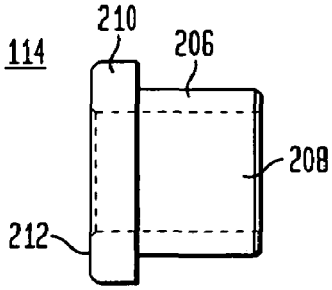
FIGS. 10A–10B show a small diameter collar for the tensioning member of FIG. 7.
Figure 10B:
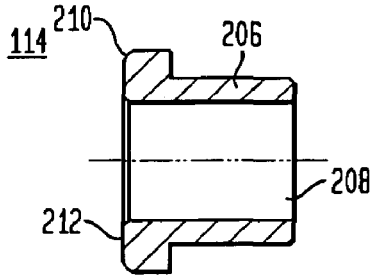

Referring to FIGS. 10A–10B, the small diameter collar 114 has an outer wall 206 defining a central opening 208 sized to enable the threaded rod 124 (FIG. 1) to pass therethrough. The small diameter collar 114 also includes a head 210 and a top face 212 adapted to engage the head 125 of threaded rod 124 (FIG. 7).

Figure 11:
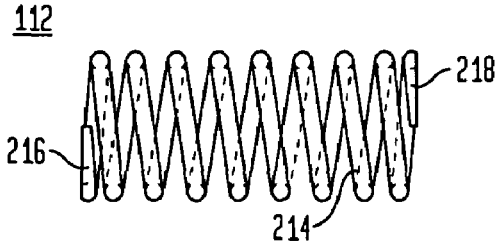
FIG. 11 shows a compression spring for the tensioning member of FIG. 7.

Referring to FIG. 11, compression spring 112 includes helically wound coils 214. The compression spring has an opening at the first end 216 thereof adapted to receive the outer wall 206 of small diameter collar 114. The compression spring 112 also includes a second opening at the second end 218 adapted to receive the central hub 202 of large diameter collar 110.

Figure 12:
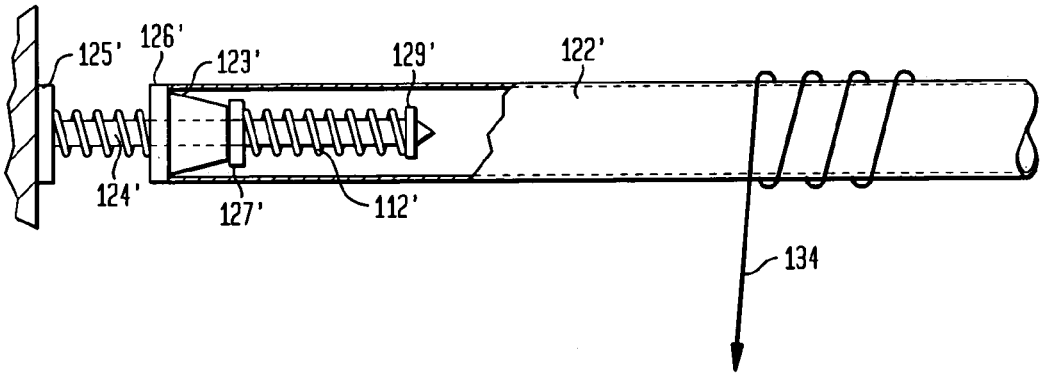
FIG. 12 shows a tensioning member for a cordless blind assembly, in accordance with further preferred embodiments of the present invention.

FIG. 12 shows a tensioning member for a cordless blind assembly, in accordance with further preferred embodiments of the present invention. The tensioning member is located within tube 122' having a first end 123' with a threaded plug 126' secured therein. The assembly includes a threaded rod 124' having a first end, including a head 125', and a second end threaded into the threaded opening of threaded plug 126'. A compression spring 112' is inserted over the second end of the threaded rod 124' between washer 127' and retainer 129'. As the cordless blind assembly is pulled down, the lift cord 134' is unwound from the tube and the tube 122' traverses to the left. Leftward movement of the tube compresses compression spring 112', which increases the axial force applied to the end of the tube.

Figure 13A:
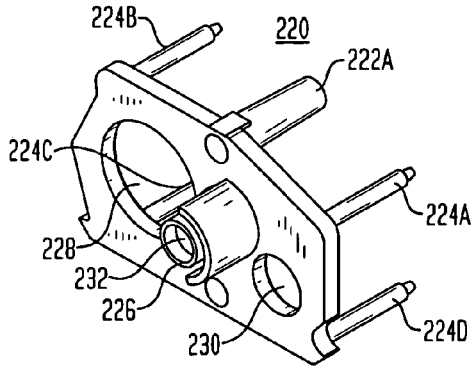
FIGS. 13A and 13B show a right hand power plate for a spring motor for the cordless blind assembly shown in FIG. 1.
Figure 13B:
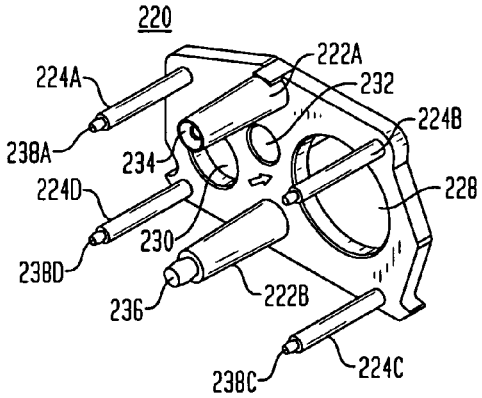

FIGS. 13A–13B and 14A–14B show power plates for the power assembly 144 shown in FIG. 1. Referring to FIGS. 13A–13B, right hand power plate 220 includes a pair of large posts 222*a* and 222*b*, four smaller posts 224*a*–224*d*, a stub shaft 226, a large diameter hole 228 and a small diameter hole 230. The right hand power plate 220 also includes a stub shaft throughbore 232 for enabling a drive shaft to pass therethrough, as will be described in more detail below. The upper large post 222*a* preferably includes a female opening 234 and the second large post 222*b* includes a male end projection 236. Each of the smaller posts 224*a*–224*d* desirably have male end projections 238*a*–238*d*.

Figure 14A:
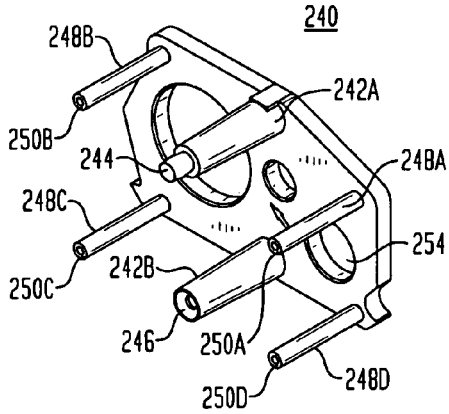
FIGS. 14A and 14B show a left hand power plate for a spring motor for the cordless blind assembly shown in FIG. 1.
Figure 14B:
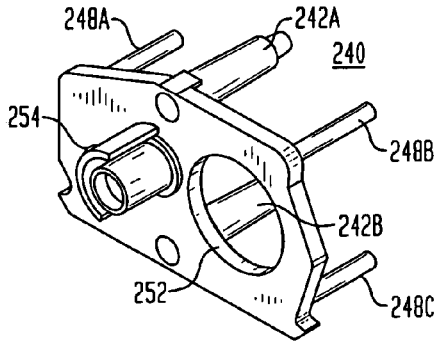

Referring to FIGS. 14A–14B, the power assembly also includes a left hand power plate 240 having a pair of large posts 242*a* and 242*b*. The first large post 242*a* includes a male projection 244 and the second large post 242*b* includes a female opening 246. The large posts 222*a*, 222*b*, 242*a*, 242*b* of the respective right and left end power plates 220, 240 are adapted to snap-fit together. The left hand power plate 240 also includes smaller posts 248*a*–248*d* having female openings 250*a*–250*d*. The left hand power plate 240 includes a large diameter opening 252 and a small diameter opening 254.

Figure 15A:
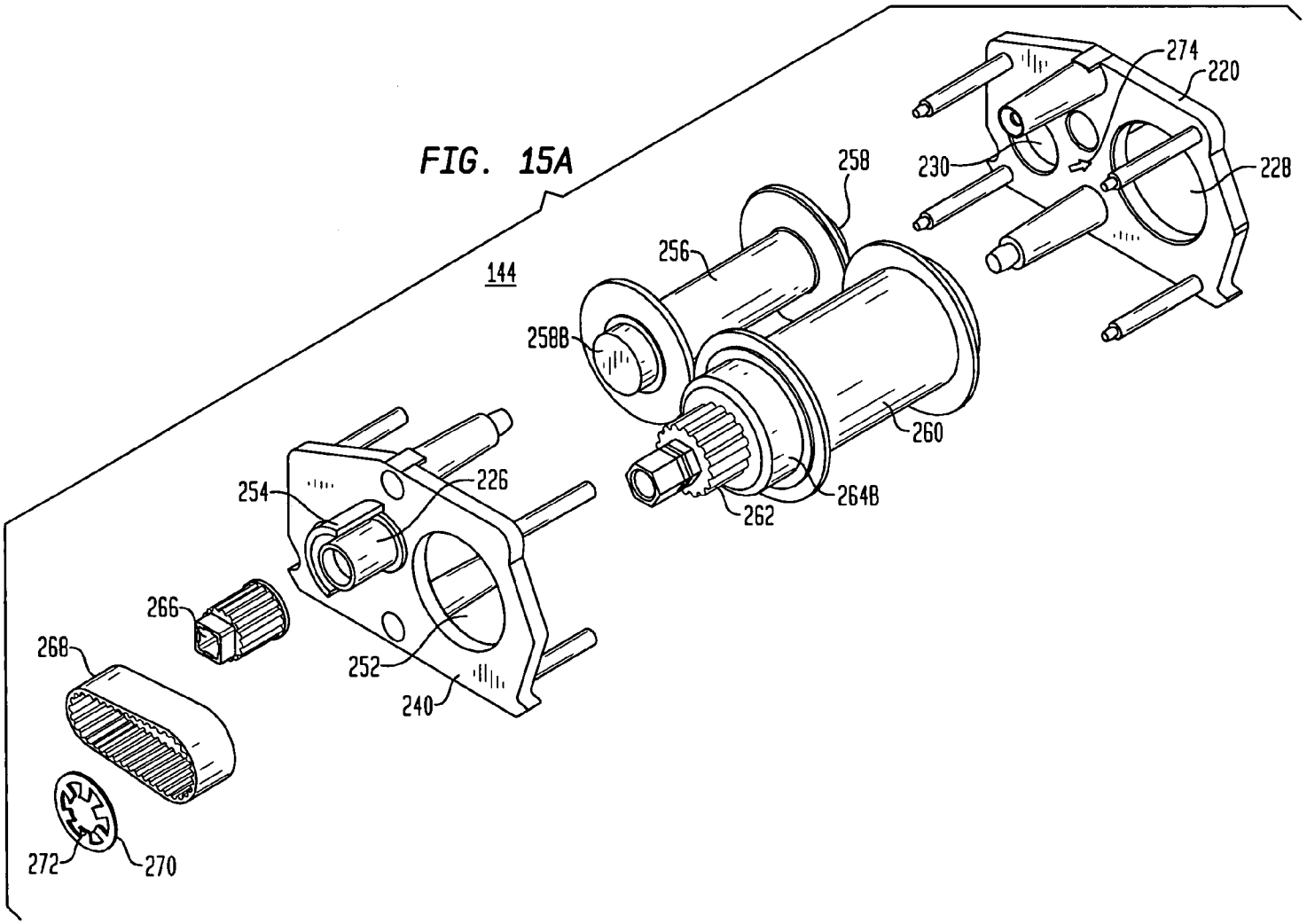
FIGS. 15A and 15B show exploded views of a spring motor for the cordless blind assembly of FIG. 1.
Figures 15B, 16:
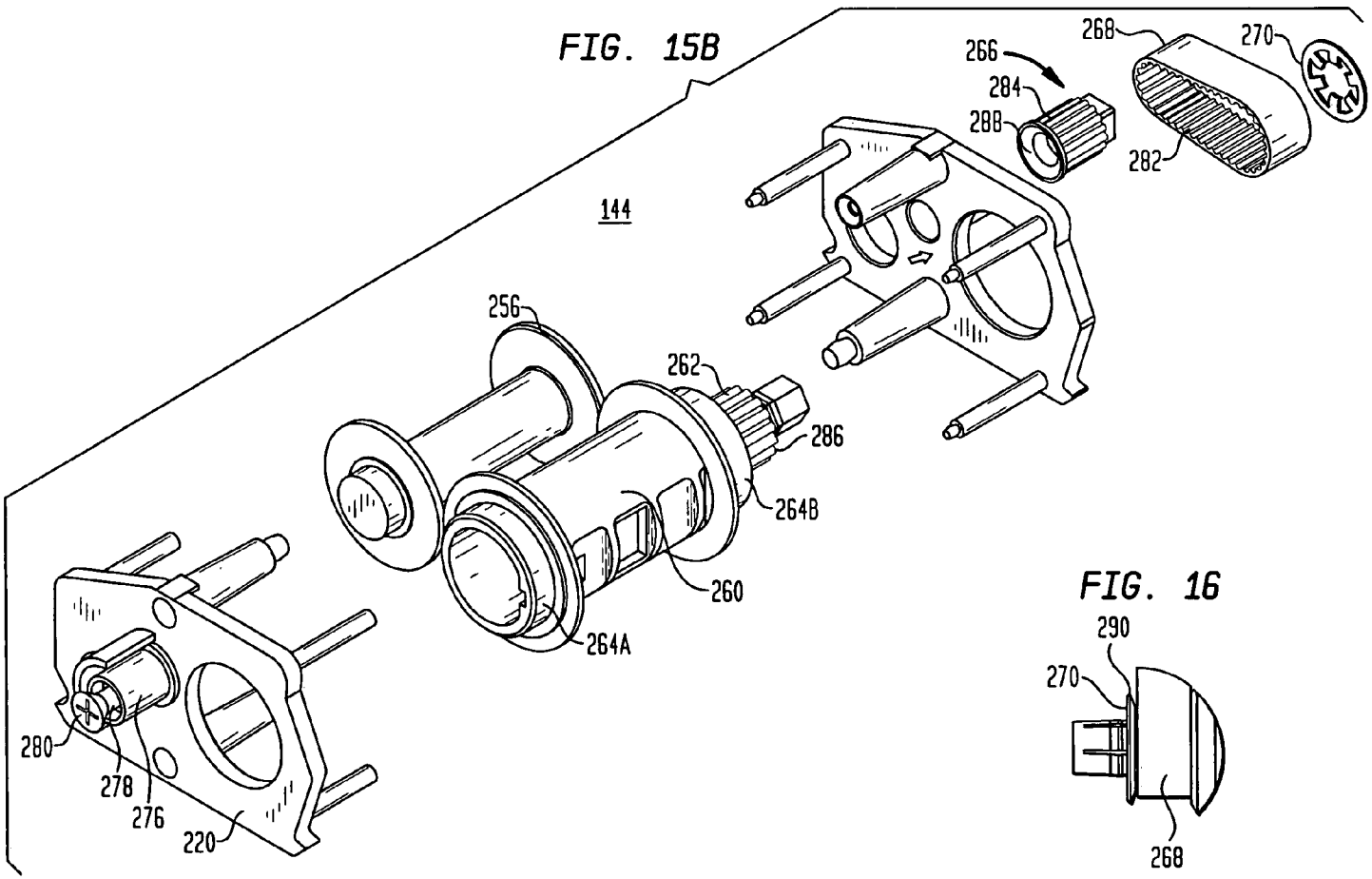
FIG. 16 shows a fragmentary view of the spring motor of FIG. 15A in an assembled configuration.

FIGS. 15A and 15B show an exploded view of the power assembly of FIG. 1, in accordance with certain preferred embodiments of the present invention. The power assembly includes right hand power plate 220 and left hand power plate 240. The power assembly also includes storage drum 256 having opposing hubs 258*a*, 258*b* for rotating within small diameter openings 230 and 254 of the respective power plates. The assembly also includes an output drum 260 having an output drum gear 262 integrally molded thereto. The output drum includes bearing surfaces 264*a*, 264*b* that rotate within large diameter openings 228, 252 of the respective power plates. The power plate assembly 144 also includes a pulley 266 adapted to be fit over stub shaft 226, a timing belt 268 that engages pulley 266 and output drum gear 262 and a retainer ring 270 having inwardly projecting teeth 272. The exploded assembly shown in FIGS. 15A and 15B does not show a spring wrapped around storage drum and output drum 260. In operation, the spring preferably travels under the storage drum 256 and over the output drum 260 in the direction indicated by the arrow designated 274 in FIGS. 15A and 15B. The spring preferably stores and releases tension from the power assembly.

Referring to FIG. 15B, the right hand power plate 220 includes screw anchor post 276 having an internally threaded opening 278 with screw 280 secured in the threaded opening 278. Timing belt 268 includes teeth 282 that mesh with teeth 284 on pulley 266 and teeth 286 on output drum gear 262. Pulley 266 includes an annular opening 288 that is adapted to receive stub shaft 226 so that the pulley 266 is free to rotate about stub shaft 226.

Referring to FIG. 16, retainer 270 preferably includes a curved face 290 that faces timing belt 268 for holding the timing belt in place over output drum gear 262 (not shown).

Figure 17A:
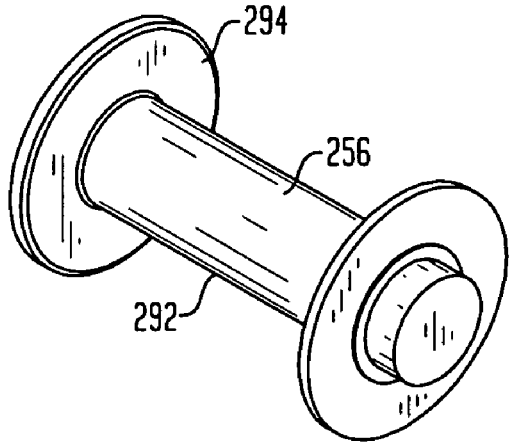
FIGS. 17A–17C show a storage drum for the spring motor of FIG. 15A.
Figure 17B:
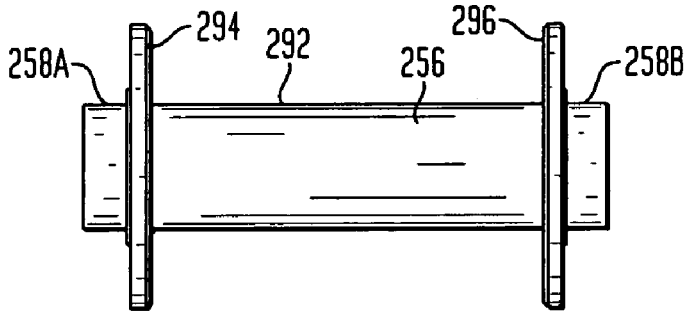
Figure 17C:
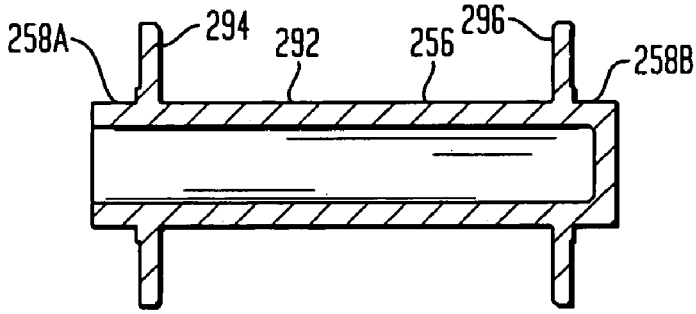
Figure 18A:
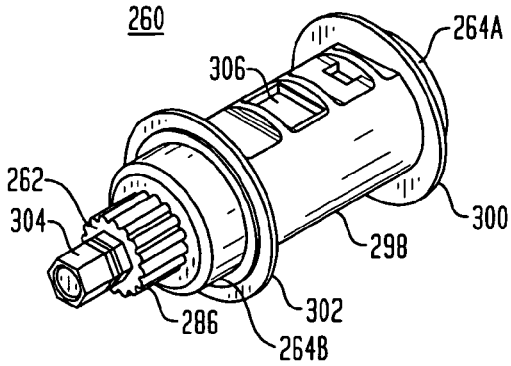
FIGS. 18A–18E show an output drum for the spring motor of FIG. 15A.
Figure 18B:
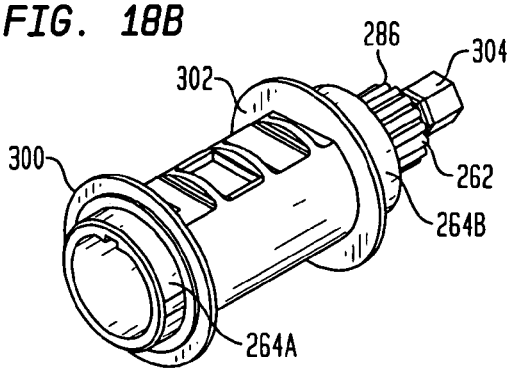
Figure 18C:
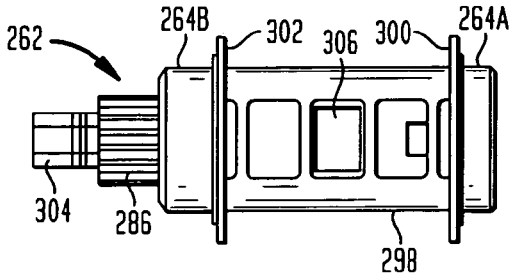
Figure 18D:
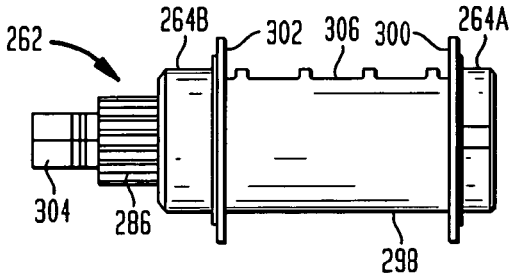
Figure 18E:
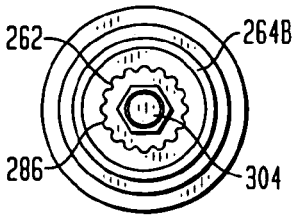

FIGS. 17A–17C show storage drum 256 having an outer surface 292, a first retaining surface 294, a second retaining surface 296, a first bearing surface 258*a* and a second bearing surface 258*b*.

Referring to FIGS. 18A–18E, output drum 260 has an outer spring engaging surface 298, a first retaining surface 300 and a second retaining surface 302. The output drum 260 also includes first bearing surface 264*a* and second bearing surface 264*b*. An output drum gear is integrally molded to output drum 260. The output drum gear 262 includes teeth 286 and an hexagonal projection 304 projecting therefrom. The hexagonal projection 304 is adapted to engage the teeth 272 of retainer ring 270 (FIG. 15A). The output drum 260 includes one or more openings 306 extending through the outer wall 298 thereof for receiving and securing an end of a spring (not shown).

Figure 19A:
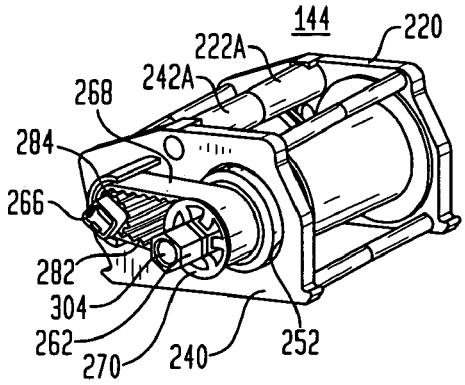
FIGS. 19A–19F show the spring motor of FIG. 15A after full assembly thereof.

FIGS. 19A–19F show the power assembly 144 after all the components described above have been assembled together. Referring to FIG. 19A, right hand power plate 220 and left hand power plate 240 are snap fit together by large posts 222*a* and 242*a*. Pulley 266 is assembled over the stub shaft (not shown) and output drum gear 262 projects through the large diameter opening 252 of the left hand power plate 240. The timing belt 268 has teeth 282 that mesh with the teeth 284 of pulley 266, as well as the teeth (not shown) of the output drum gear 262. Retainer ring 270 is secured over hexagonal projection 304 for holding the timing belt 268 in engagement with the teeth of the output drum gear 262.

Figure 19B:
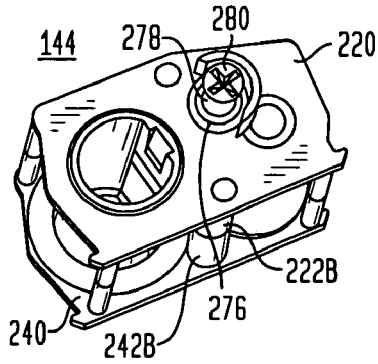
Figure 19C:
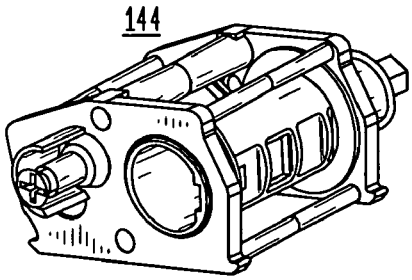

FIG. 19B shows a right side perspective view of the assembly including screw 280 secured in threaded opening 278 of screw anchor post 276. The large posts 222B, 242B of the opposing power plates 220, 240 are snap-fit together.

Figure 19D:
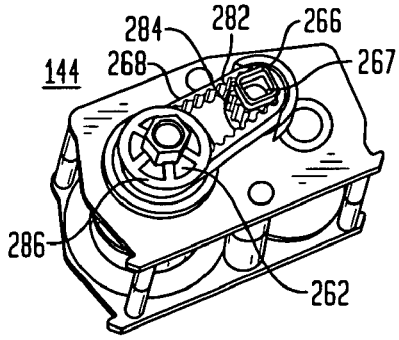
Figure 19E:
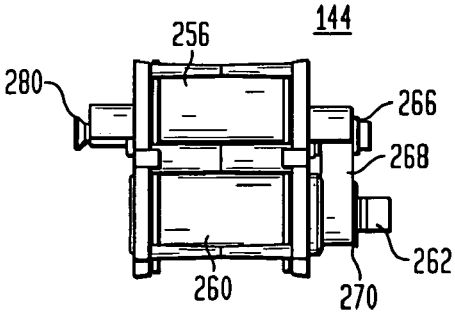

FIG. 19D shows timing belt 268 having teeth 282 that mesh with the teeth 284 of pulley 266 and the teeth 286 of output drum gear 262. FIG. 19E shows a top plan view of the power assembly 144 of the present invention including storage drum 256 and output drum 260. Screw 280 is adapted for engaging an end cap of the headrail for holding the power assembly 144 securely in place. Retainer ring 270 holds timing belt 268 in proper engagement with output drum gear 262 and pulley 266.

Figure 19F:
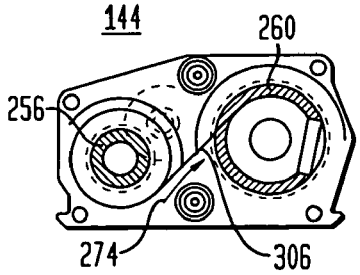

FIG. 19F shows storage drum 256, output drum 260 and spring 306 passing between storage drum 256 and output drum 260. The spring 306 travels in the direction indicated by the arrow designated 274. As noted above, the spring is utilized to store and release tension from the power assembly 144.

Figure 20:
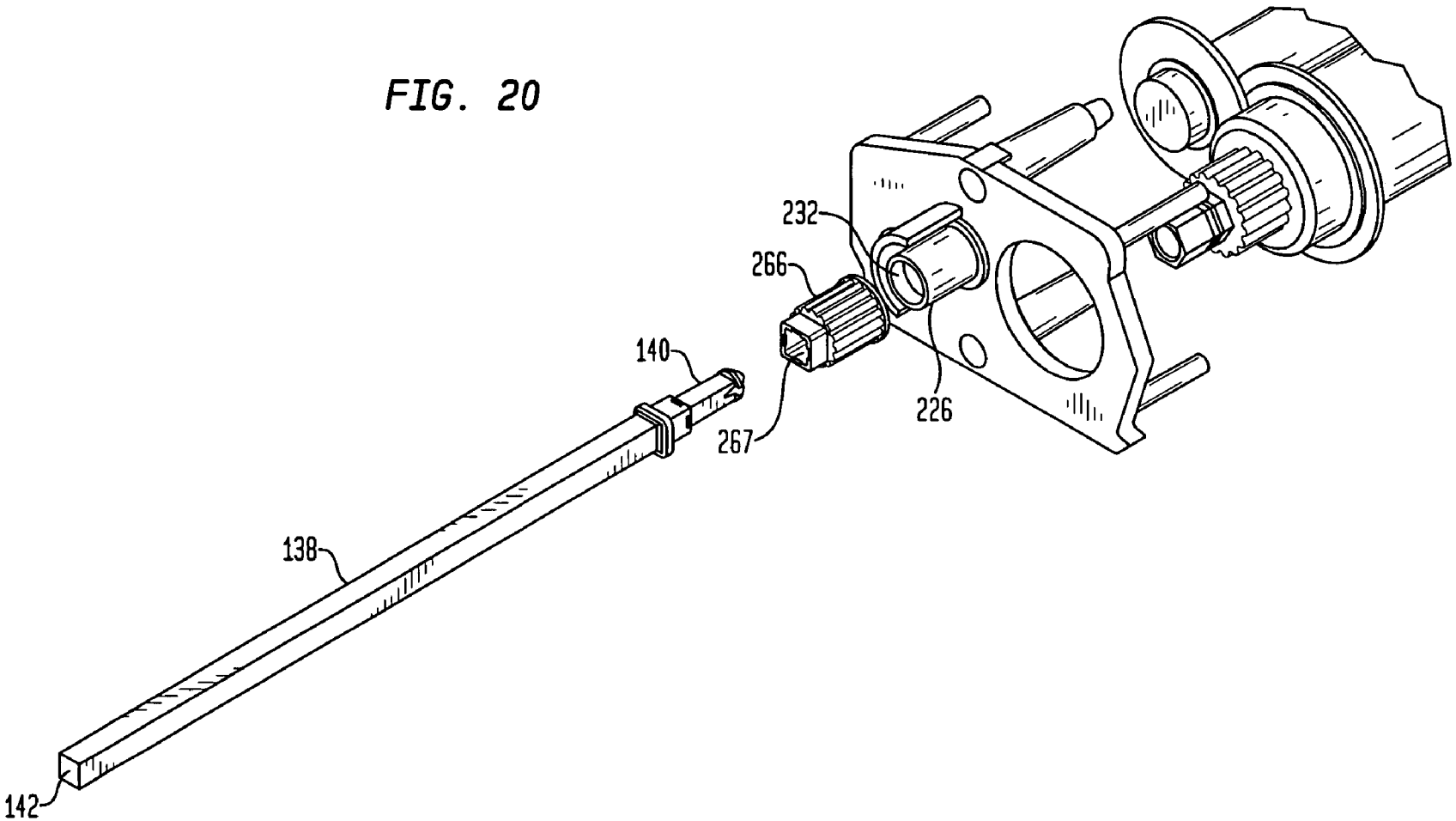
FIG. 20 shows a drive shaft connectable with the spring motor of FIG. 15A.
Figure 23A:
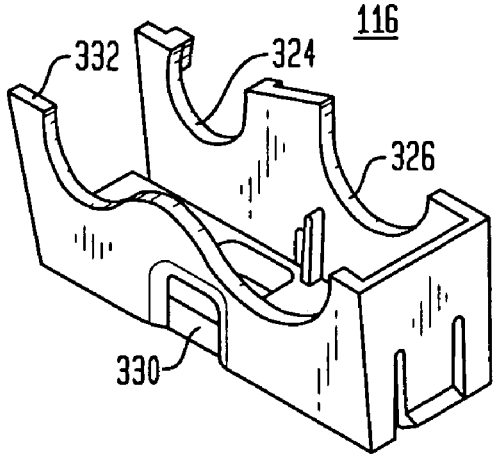
FIGS. 23A–23E show a cradle for the cordless blind assembly of FIG. 1.
Figure 23B:
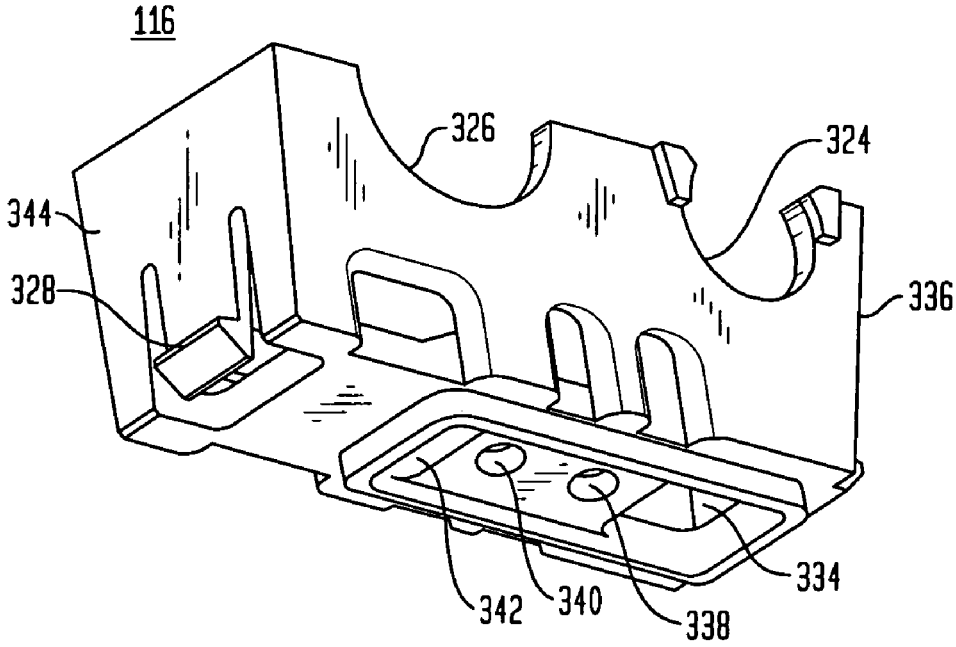
Figure 23C:
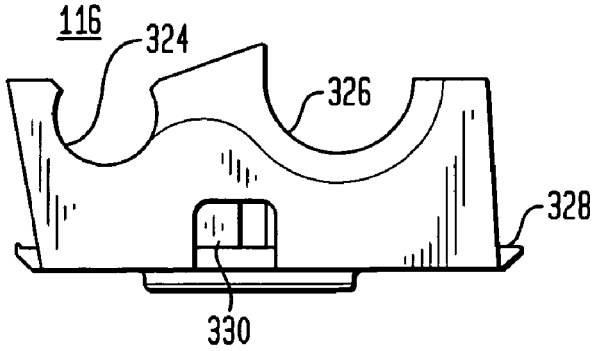
Figure 23D:
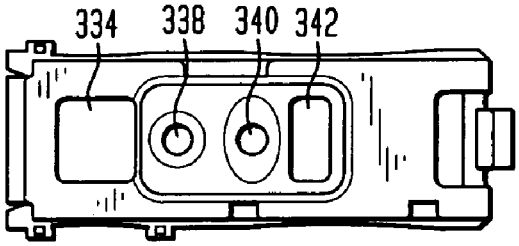
Figure 23E:
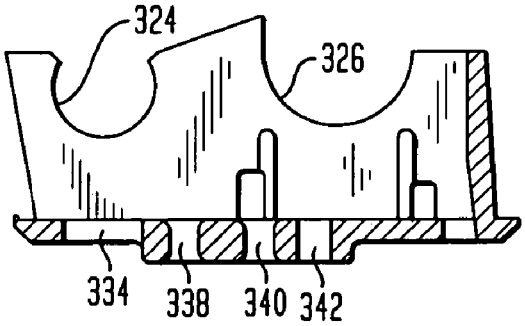

FIGS. 20 and 21A–21C show a drive shaft 138 having a first end 140 and a second end 142, the first end being adapted to mesh with the square opening 267 of pulley 266. Referring to FIG. 21A, drive shaft 138 has a square-shaped outer surface when viewed in cross-section. The square-shaped outer surface is best shown in FIG. 21C. Referring to FIG. 21B, drive shaft 128 includes stop ring 310, snap barbs 312 and bifurcated end 314. The bifurcated end 314 includes an upper arm 316 and a lower arm 318 that may be compressed toward one another. Referring to FIGS. 20 and 21B, during assembly the bifurcated end 314 is inserted into the square shaped opening 276 of pulley 266 and passes through the opening 232 of stub shaft 226. As the bifurcated end 314 is passing through the stub shaft, the arms 316 and 318 are compressed together. After the bifurcated end 314 has been fully inserted through the stub shaft, the two arms 316, 318 are free to flex away from one another so that the retaining barbs 320, 322 engage the inside surface of right hand power plate 220 for holding the drive shaft secured to the power plate. The retaining barbs 320, 322 are angled away from the tip of the bifurcated end 314 for increasing grip as axial load increases. At this point, the drive shaft is free to rotate simultaneously with pulley 266. The square outer surface of the drive shaft between the stop ring 310 and the barbs 312 has a square outer surface that closely engages the square or square-shaped opening 267 of pulley 266. FIG. 22 shows the drive shaft 138 assembled with the power assembly 144. As a result, any rotation of pulley 266 will drive the drive shaft 138, and rotation of the drive shaft will rotate pulley 266

FIGS. 23A–23E show a cradle 116 adapted to facilitate rotational and traversing movement of a tube 122 (FIG. 1). The cradle 116 includes a tube bearing surface 324, a ladder drum bearing surface 326 and a securing element 328 adapted for securing cradle 116 to the headrail of the assembly. The cradle has a side window 330 passing through a side wall 332 thereof. The cradle also includes a ladder opening 334 adjacent a front end 336 of the cradle, a first opening 338 for a lift cord, a second opening 340 for a second lift cord and a second ladder opening 342 adjacent the rear end 344 of cradle 116.

FIGS. 24A–24D show a threaded rod 124 having a tip end 344 and head 125 remote from tip end 344. The threaded rod 124 includes threads 348 extending between tip end 344 and head 125. Head 125 includes a substantially V-shaped notch 350 formed therein. In other preferred embodiments, the V-shaped notch may have different geometric shapes.

Figure 25A:
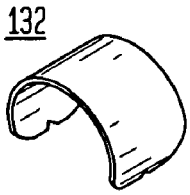
FIGS. 25A–25C show a clip for the cordless blind assembly of FIG. 1.
Figure 25B:
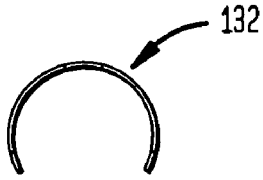
Figure 25C:
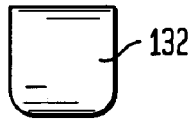

FIGS. 25A–25C show clip 132, preferably made of a flexible material such as metal. The clip 132 is fastened over the outer surface of tube 122 (FIG. 26A) for holding an end of cord 134 securely fastened to the tube 122.

Figure 26A:
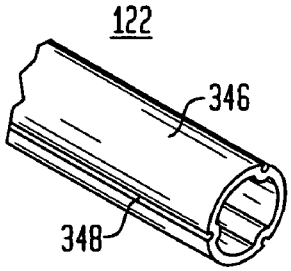
FIGS. 26A–26B show a traversing tube for the cordless blind assembly of FIG. 1.
Figure 26B:
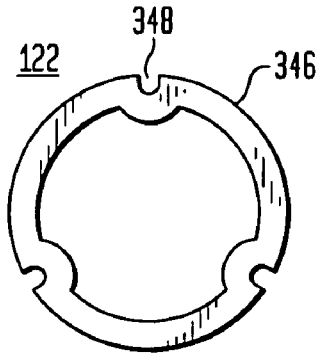

FIGS. 26A and 26B show tube 122 having an outer surface 346 with elongated grooves 348 formed therein. In certain preferred embodiments, the tube has one elongated groove. In other preferred embodiments, the tube has two, three or more elongated grooves.

Figure 27A:
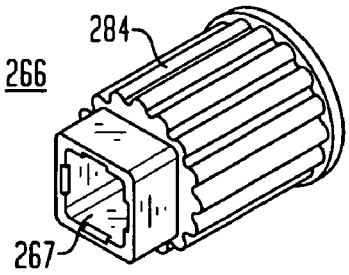
FIGS. 27A–27B show a pulley for the spring motor of FIG. 15A.
Figure 27B:
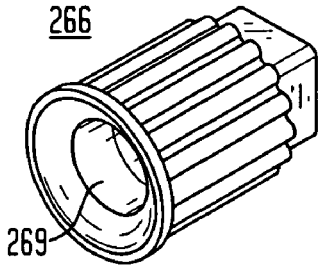

FIGS. 27A and 27B show pulley 266 having teeth 284 and a square shaped opening 267 formed at one end thereof. As noted above, the square shaped opening 267 is adapted to receive the square-shaped outer surface of the drive shaft so that the pulley 266 and drive shaft rotate simultaneously with one another. Referring to FIG. 27B, the opposite end of pulley 266 includes an annular opening 269 adapted to engage the outer surface of stub shaft 226 (FIG. 13A).

Figure 28A:
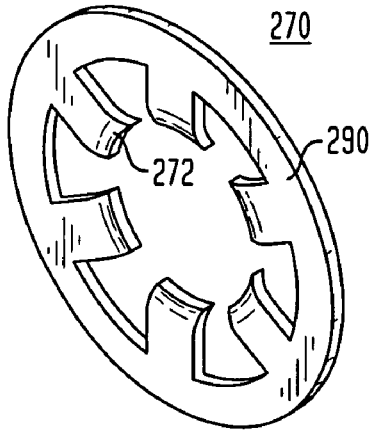
FIGS. 28A–28C show a retainer ring for the spring motor of FIG. 15A.
Figure 28B:
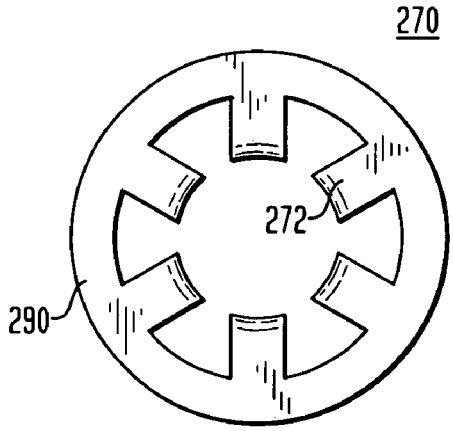
Figure 28C:
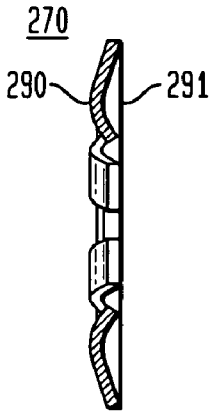

FIGS. 28A–28C show retainer 270 including inwardly projecting teeth 272. The retainer 270 has a curved surface 290. In certain preferred embodiments, the retainer 270 includes a substantially convex surface 291 opposite the curved surface 290.

Figure 29:
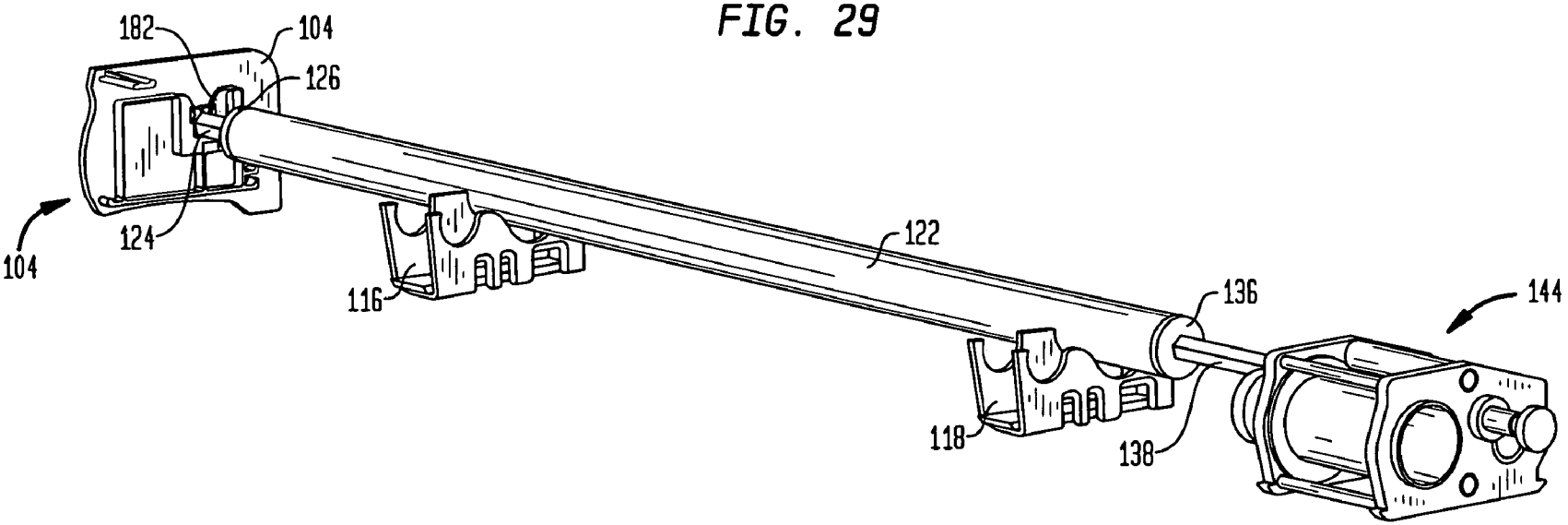
FIG. 29 shows a perspective view of the tube of FIG. 26A coupled with the spring motor of FIG. 15A, in accordance with certain preferred embodiments of the present invention.

FIG. 29 shows the power assembly 144 of FIG. 15A coupled with tube 122 by drive shaft 138. The tube 122 has an opening at a right end thereof and a drive plug 136 inserted in the opening. The tube is supported by a first cradle 116 and a second cradle 118. The cradles include bearing surfaces that facilitate rotational and traversing movement of tube 122. The left end of tube 122 is supported by end cap 104 having notch 182 formed therein for supporting a head of threaded rod 124. The threaded rod 124 is secured in threaded plug 126 attached to the end of tube 122.

Figure 30:
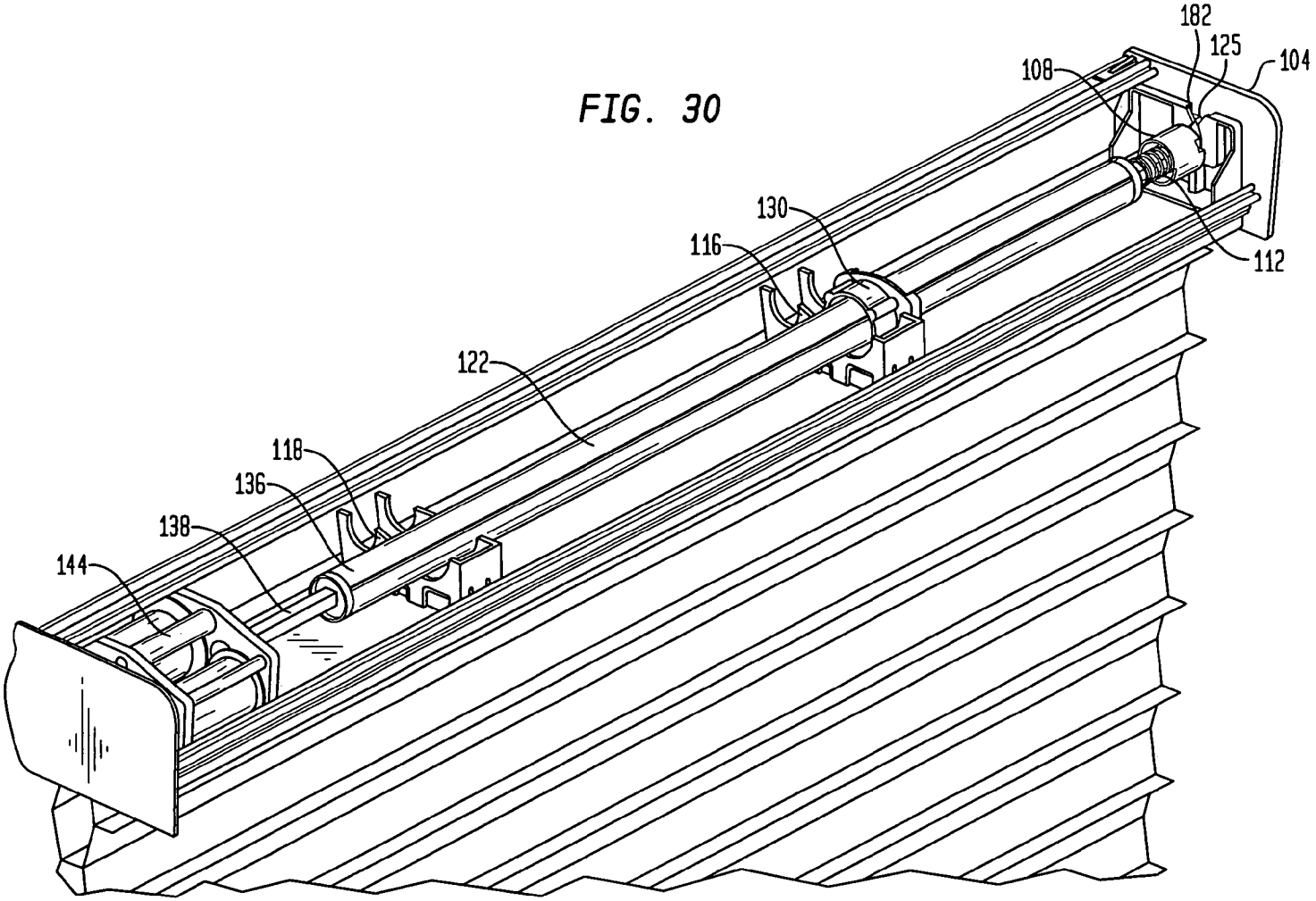
FIG. 30 shows the cordless blind assembly of FIG. 1 after assembly thereof, headrail in accordance with certain preferred embodiments of the present invention.

FIG. 30 shows another preferred embodiment of the present invention including power assembly 144 connected with tube 122 via drive shaft 138. The drive shaft 138 has a first end connected with the power assembly 144 and a second end that engages drive plug 136 secured in an opening of tube 122. An opposite end of tube 122 is secured to left hand headrail end cap 104 by head 125 of threaded rod 124 (not shown). The head 125 of threaded rod 124 is secured within a notch 182 formed in left hand headrail end cap 104. A tensioning member 108 including a compression spring 112 is secured between the end of tube 122 and left hand headrail end cap 104. A first cradle 116 and a second cradle 118 support rotational and traversing movement of tube 122. A cradle cover 130 is coupled to first cradle 116.

Figure 31:
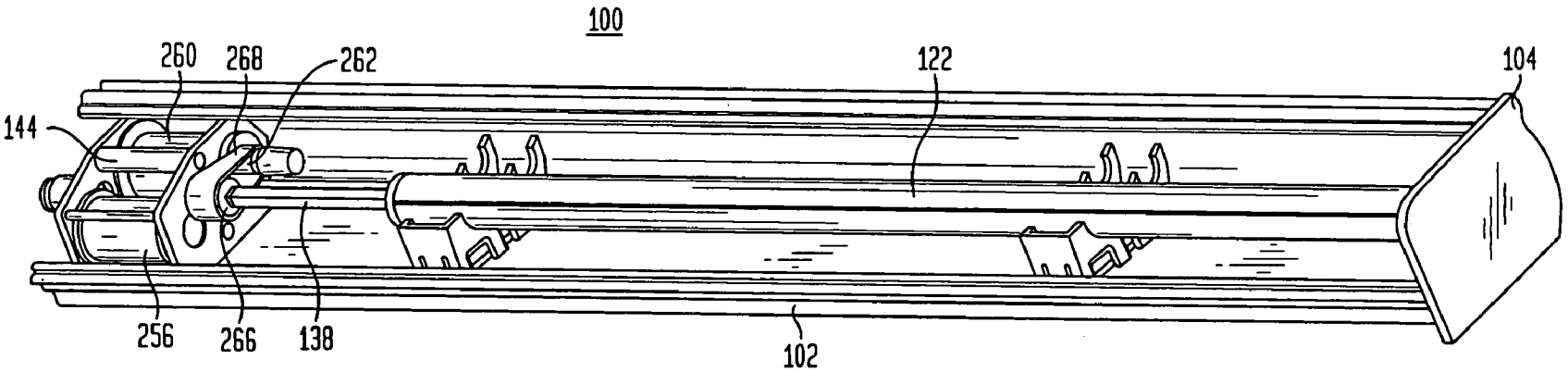
FIG. 31 shows another view of the assembly of FIG. 30.

FIG. 31 shows another perspective view of a cordless blind assembly 100 including headrail 102 supporting power assembly 144 and tube 122. The power assembly 144 includes pulley 266 coupled with drive shaft 138. As will be described in more detail below, during downward movement of the cellular shade, tube 122 rotates as the lift cords (not shown) are unwound from the tube 122. In turn, rotation of tube 122 drives drive shaft 138, which in turn rotates pulley 266. Rotation of pulley 266 drives timing belt 268, which, in turn, rotates output drum gear 262. Rotation of output drum gear 262 rotates output drum 260, which takes up the spring stored on storage drum 256. Referring to FIGS. 30 and 31, as the cordless blind is pulled downward, the threaded rod 124 attached to the left hand rail end cap 104 causes tube 122 to move to the right. This causes the tension member, and particularly the spring 112 of the tension member 108, to compress, which places axial holding forces on the remote end of tube 122. The axial holding force tends to hold the tube stationary and in place.

Figure 32:
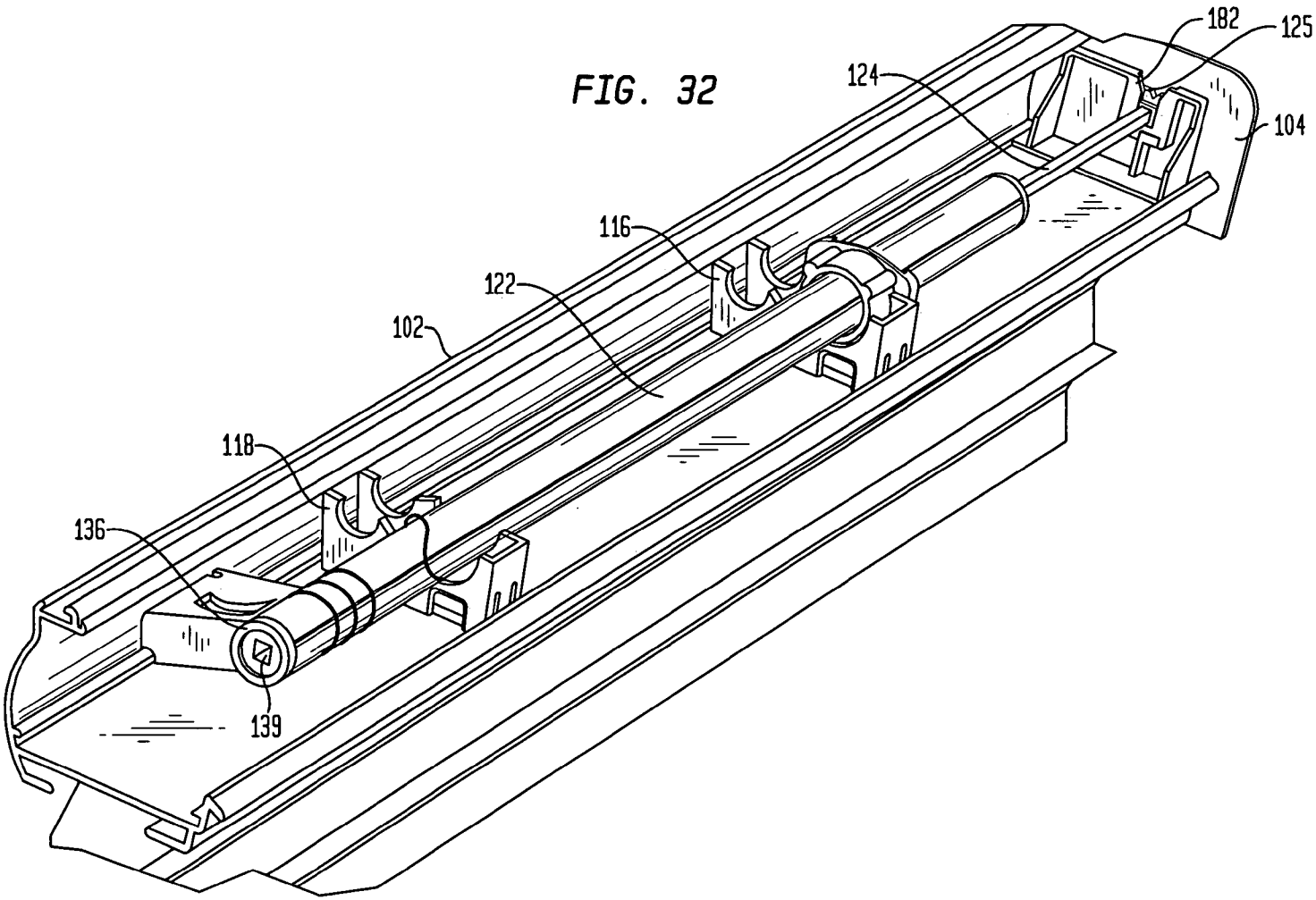
FIG. 32 shows another view of the assembly of FIG. 30.

FIG. 32 shows yet another view of the assembly of the present invention including headrail 102 and left hand end cap 104 supporting rotation of tube 122. The assembly includes a first cradle 116 and a second cradle 118. The first and second cradles 116, 118 support rotational and traversing movement of tube 122. The first end of tube 122 has secured therein a drive plug 136 with a preferably square opening 139 adapted to receive the square cross-sectional shaped drive rod (not shown). As noted above, left hand headrail end cap 104 includes a notch 182 for securing head 125 of threaded rod 124.

Figure 33:
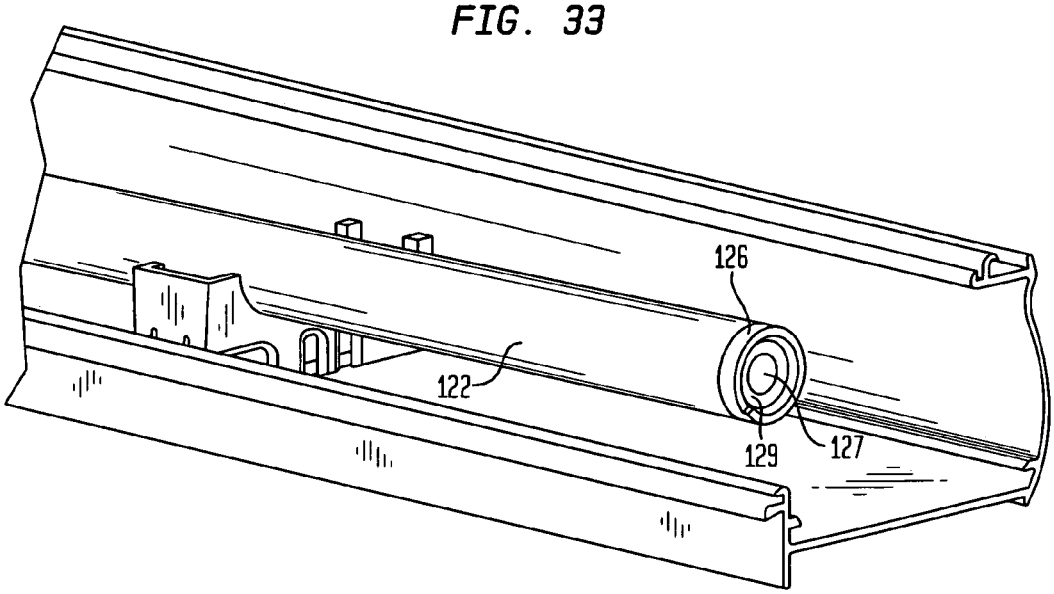
FIG. 33 shows another view of the assembly of FIG. 30.

FIG. 33 shows the second end of tube 122 including threaded plug 126 having a central opening 127 with threads 129. The threads 129 of the threaded plug 126 engage the external threads of threaded rod 124 (FIG. 32). As the tube rotates in the counterclockwise direction, the tube traverses to the right along the threaded rod for moving the second end of the tube 122 closer to the left-most end of headrail 102.

Figure 34:
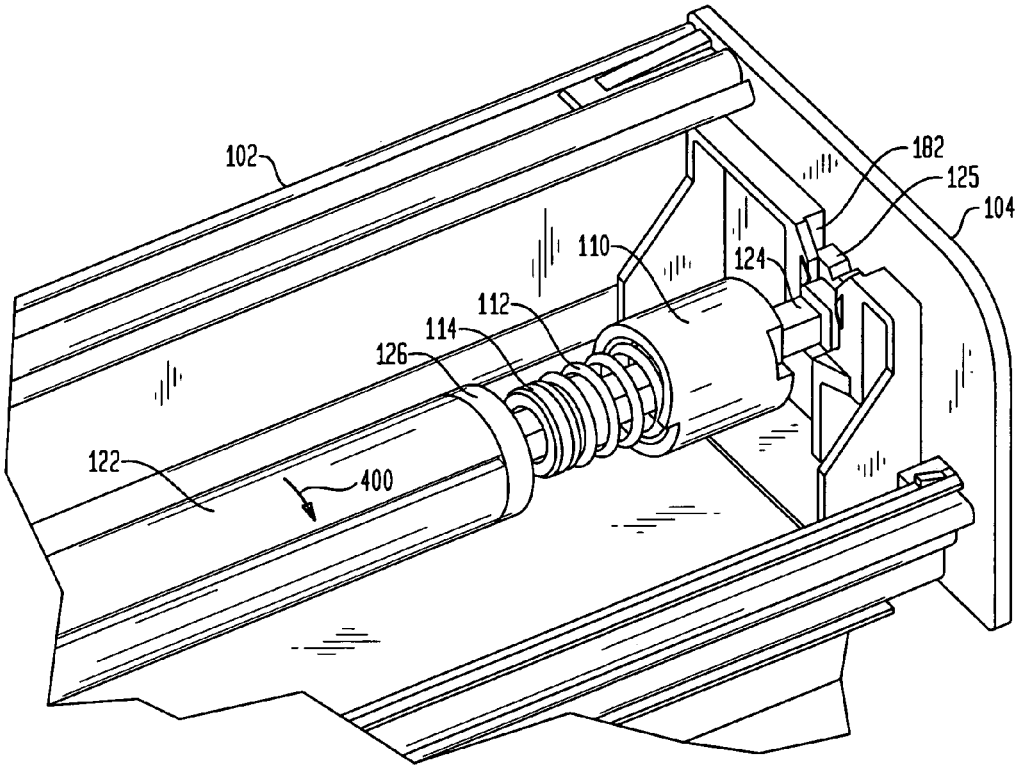
FIG. 34 shows the tensioning member of FIG. 7 between a traversing tube and a left hand headrail end cap, in accordance with certain preferred embodiments of the present invention.

FIG. 34 shows an expanded view of tensioning member 108 including large diameter collar 110, small diameter collar 114 and compression spring 112 disposed between the large diameter collar 110 and the small diameter collar 114. Threaded road 124 has a head 125 secured in notch 182 of left hand headrail end cap 104. The assembly includes threaded plug 126 secured in an opening at the end of tube 122 for engaging the external threads (not shown) of threaded rod 124. The tensioning member 108 is secured between the threaded plug 126 and the left hand headrail end cap 104. As the cellular shade is payed out, the tube 122 rotates in a direction indicated by arrow 400. As the tube 122 rotates, the tube 122 moves to the right for abutting threaded plug 126 against small diameter collar 114. Further rightward movement of tube 122 compresses the tensioning member 108 between the threaded plug 126 and the inner face of left hand headrail end cap 104. Further paying out of the cellular shade results in further rightward movement of tube 122 for providing further axial force by the tensioning member 108. As the cellular shade is lifted up toward the headrail 102, the tube 122 rotates in an opposite direction from the direction indicated by arrow 400 and the tube moves leftward along the threaded rod 124. This reduces the amount of compression upon the tensioning member 108.

Figure 35:
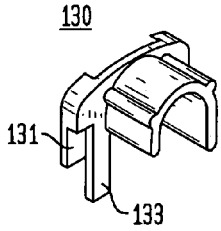
FIG. 35 shows a cradle cover for the cordless blind assembly of FIG. 1, in accordance with certain preferred embodiments of the present invention.
Figure 36:
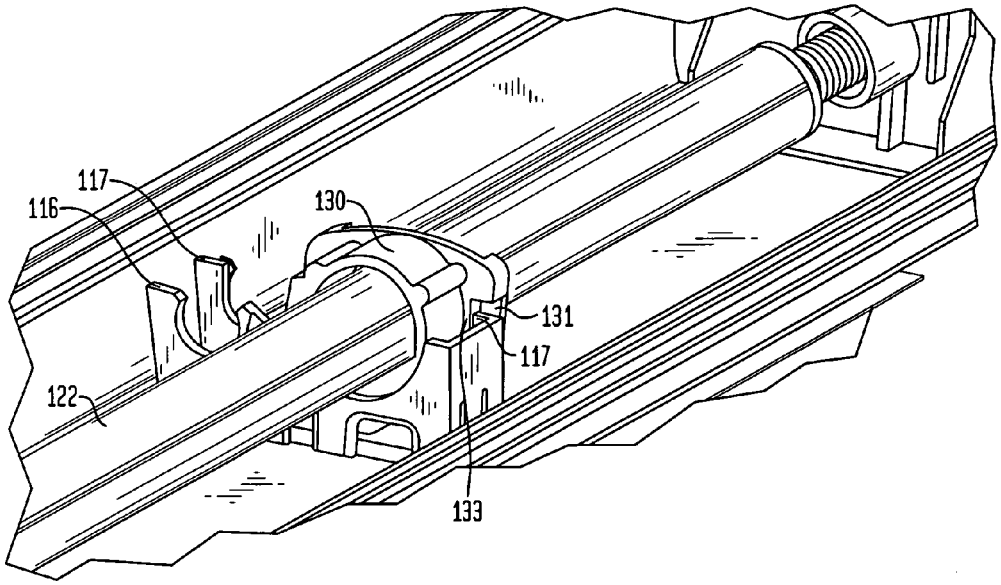
FIG. 36 shows the cradle cover of FIG. 35 assembled with a cradle and overlying a traversing tube.

FIG. 35 shows a cradle cover 130 which may be assembled over a cradle 116 that supports a rotating tube. The cradle cover 130 includes first and second opposing flanges 131, 133 that facilitate securing the cradle cover 130 to cradle 116. Referring to FIG. 36, cradle cover 130 is secured over cradle 116 so that tube 122 is moveable between the cradle 116 and the cradle cover 130. Opposing flanges 131 and 133 facilitate attachment of cradle cover 130 to cradle 116. Specifically, a side wall 117 of cradle passes between opposing flanges 131 and 132 of cradle cover 130. Although not limited by any particular theory of operation, it is believed that cradle cover 130 prevents slack from developing in a lift cord (not shown) as the lift cord is wound and unwound from tube 122.

Figure 37:
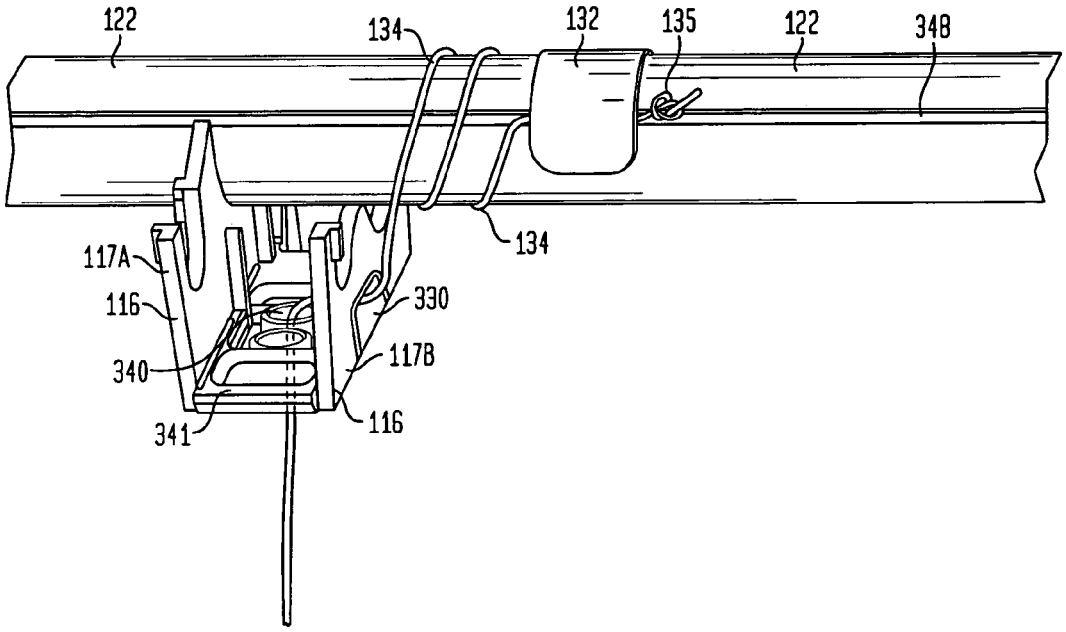
FIG. 37 shows a cradle for supporting a traversing tube with a lift cord passed through a window in the cradle in a zigzag path, in accordance with certain preferred embodiments of the present invention.

FIG. 37 shows lift cord 134 wrapped around tube 122. An end 135 of lift cord 134 is secured in an elongated groove 348 and held in the groove 348 by clip 132. The clip preferably covers the groove 348 for holding the end 135 of cord 134 in place so that the cord 134 does not move. The cord is then directed through lateral window 330 of cradle 116 and opening 340 extending through a bottom wall 341 of cradle 116. The lift cord 134 follows a zigzag path whereby the cord engages a periphery of window 330 and a periphery of opening 340. The engagement of the cord with the edges of the openings 330, 340 creates friction that is believed to provide better holding force for the cordless blind assembly. This tends to hold the cellular shade in place as it is raised and lowered relative to the window opening.

Figure 38:
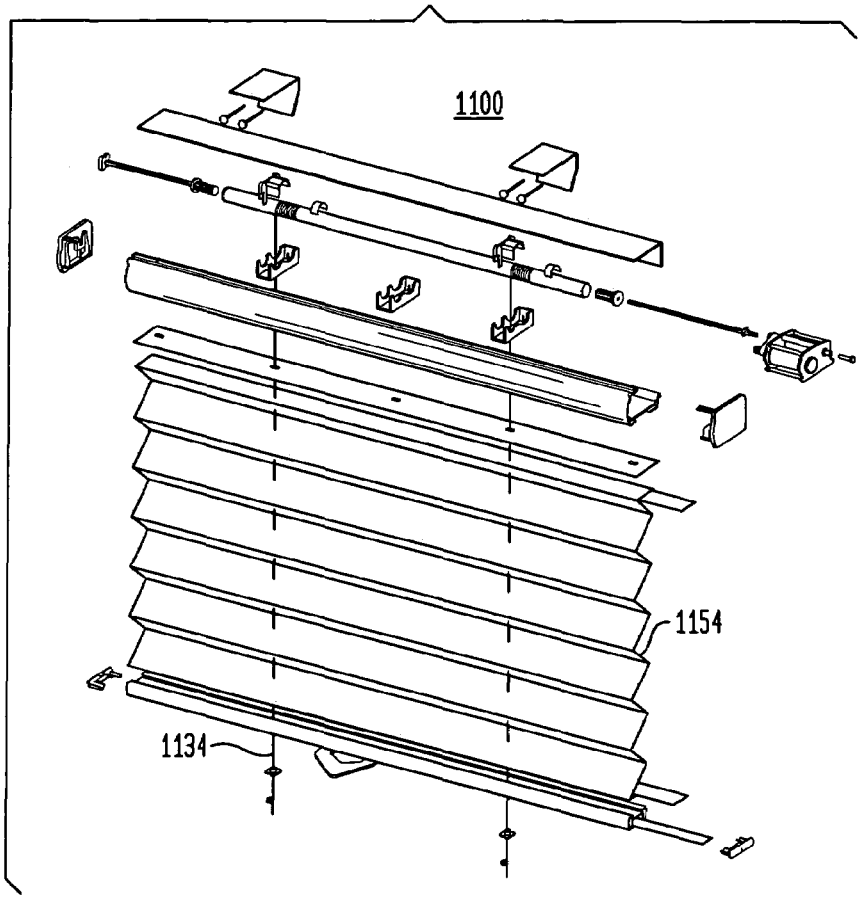
FIG. 38 shows an exploded view of a cordless blind assembly, in accordance with other preferred embodiments of the present invention.
Figure 39:
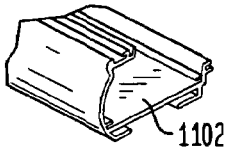
FIG. 39 shows an end view of a headrail for the assembly of FIG. 38.
Figure 41:
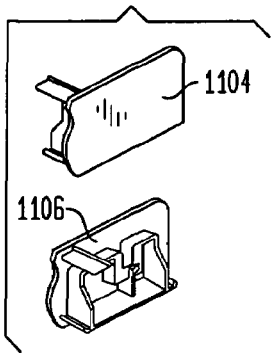
FIG. 41 shows a headrail end cap for the headrail of FIG. 39.
Figure 42:
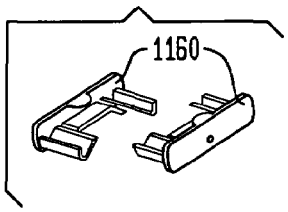
FIG. 42 shows bottom rail end caps for the bottom rail of FIG. 40.
Figure 40:
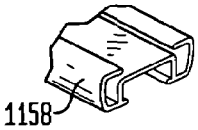
FIG. 40 shows an end view of a bottom rail for the assembly of FIG. 38.
Figure 43:
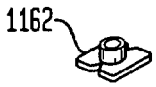
FIG. 43 shows a tie off for a lift cord for the assembly of FIG. 38.
Figure 44:
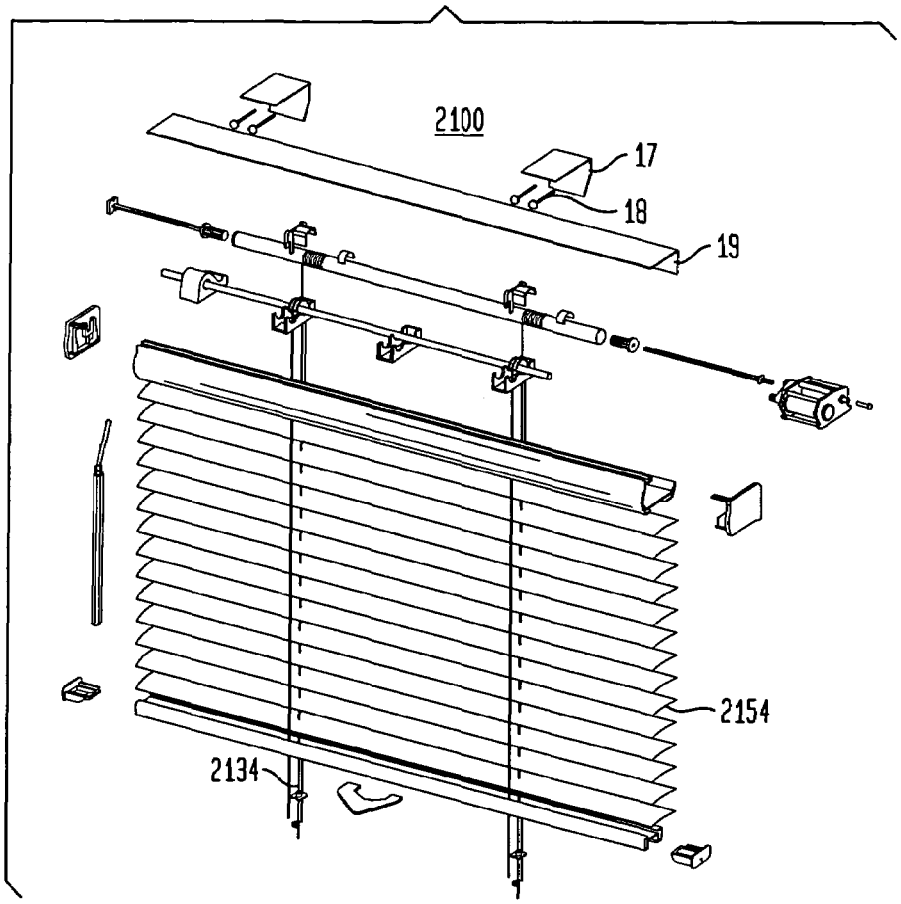
FIG. 44 shows an exploded view of a cordless blind assembly, in accordance with further preferred embodiments of the present invention.
Figure 45:
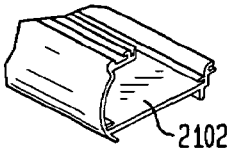
FIG. 45 shows an end view of a headrail for the assembly of FIG. 44.
Figure 46:
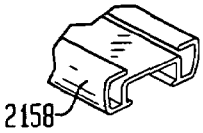
FIG. 46 shows an end view of a bottom rail for the assembly of FIG. 44.
Figure 47:
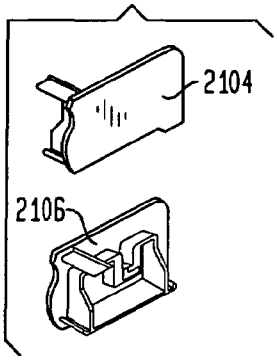
FIG. 47 shows a headrail end cap for the headrail of FIG. 45.
Figure 48:
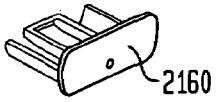
FIG. 48 shows a bottom rail end cap for the bottom rail of FIG. 46.
Figure 49:
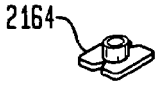
FIG. 49 shows a tie off for a lift cord for the assembly of FIG. 44.

FIG. 38 shows a pleated shade assembly 1100 in accordance with certain preferred embodiments of the present invention. The pleated shade assembly 1100 is generally similar to the assembly shown in FIG. 1, however, the window covering material is a pleated fabric 1154. Referring to FIGS. 39 and 40, the assembly 1100 includes a headrail 1102 and a bottom rail 1158. Referring to FIG. 41, the assembly includes headrail end caps 1104 and 1106 that cover the respective left and right ends of headrail 1102 shown in FIG. 39. FIG. 42 shows bottom rail end caps 1160 for capping the respective left and right ends of bottom rail 1158 shown in FIG. 40. FIG. 43 shows a tie off 1162 for tying off an end of cord 1134 that has passed through bottom rail 1158.

Referring to FIGS. 44–49, a shade assembly 2100 in accordance with another preferred embodiment of the present invention includes aluminum slats 2154, headrail 2102, and bottom rail 2158. The ends of the headrail 2102 are covered by headrail end caps 2104 and 2106. The openings at the ends of the bottom rail 2158 are covered by the bottom rail end caps 2160. The lower end of lift cord 2134 is secured to bottom rail 2158 by tie-off 2164.

Figure 50:
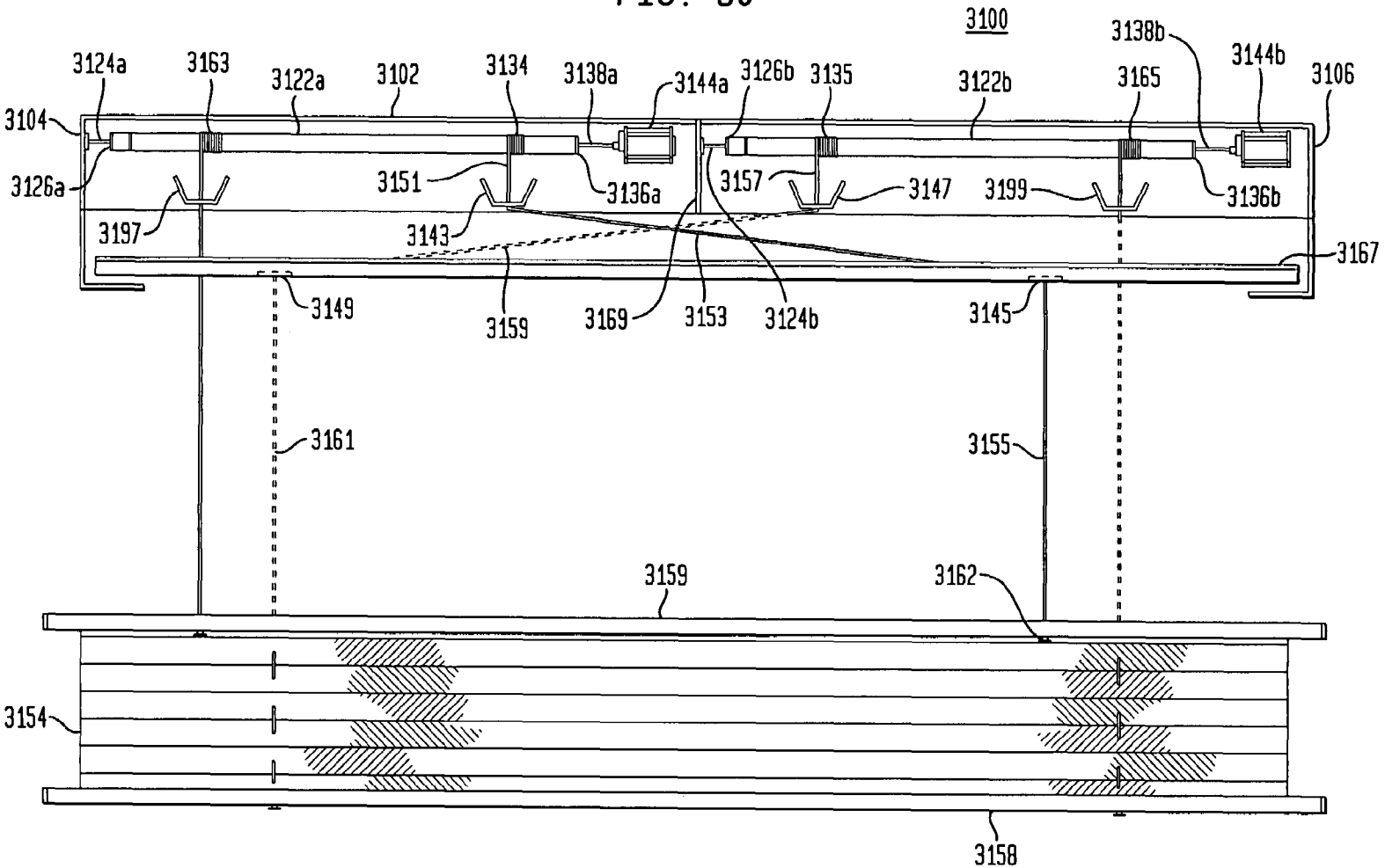
FIG. 50 shows a schematic view of a cordless blind assembly, in accordance with further preferred embodiments of the present invention.

FIG. 50 shows a window blind assembly, in accordance with other preferred embodiments of, the present invention. The window blind assembly 3100 includes a headrail 3102 having a first end 3104 and a second end 3106. The first and second ends 3104, 3106 may be covered by end caps (not shown). The assembly also desirably includes a first tube 3122*a* that is rotatably mounted within headrail 3102. The first tube 3122*a* is preferably free to rotate and traverse between the first and second ends of the headrail. A first threaded rod 3124*a* is threadably engaged with a threaded plug 3126*a* inserted into an opening at a first end of first tube 3122*a*. The assembly 3100 also desirably includes a power assembly 3144*a*, such as a spring motor, and a drive shaft 3138*a* extending between spring motor 3144*a* and a drive plug 3136*a* inserted into a second end of first tube 3122*a*.

The assembly desirably includes a second rotatable tube 3122*b*, and a second threaded rod 3124*b* threadably engaged with a threaded plug 3126*b* inserted into an opening at a first end of second tube 3122*b*. The assembly also includes a second motor 3144*b*, such as a second spring motor, coupled with a second drive plug 3136*b* secured to a second end of second tube 3122*b*. A second drive shaft 3138*b* interconnects second spring motor 3144*b* and second drive plug 3136*b*. The assembly includes a bottom rail 3158 suspended below the headrail 3102 by lift cords, as will be described in more detail below. The assembly 3100 also preferably includes an intermediate rail 3159 suspended below headrail 3102 and positioned between the headrail 3102 and the bottom rail 3158. A window covering material 3154 extends between intermediate rail 3159 and bottom rail 3158. In preferred embodiments, an upper end of window covering material 3154 is attached to intermediate rail 3159 and a lower end of window covering material is attached to bottom rail 3158. In other preferred embodiments, a second window covering material may extend between headrail 3102 and intermediate rail 3159. The second window covering material may have a different opacity, color and/or texture than the first window covering material.

The assembly includes a first lift cord 3134 (shown as one of the solid lines) having an upper end connected with first tube 3122*a* and a lower end connected to intermediate rail 3159 by lift cord tie off 3162. The assembly also includes a second lift cord 3135 (shown as one of the dashed lines) having an upper end connected with second tube 3122*b* and a lower end connected to bottom rail 3158. The assembly includes a first guide for directing first lift cord 3134 on a first path and a second guide for directing second lift cord 3135 on a second path. In certain preferred embodiments, the first guide directs the first lift cord 3134 on a path including a first leg 3151 extending away from first tube 3122*a*, a second leg 3153 extending away from first tube 3122*a* and toward the second tube 3122*b*, and a third leg 3155 extending away from second tube 3122*b* and toward the intermediate rail 3159. The second guide directs the second lift cord 3135 along a path including a first leg 3157 extending away from second tube 3122*b*, a second leg 3159 extending away from the second tube 3122*b* and toward the first tube 3122*a*, and a third leg 3161 extending away from first tube 3122*a* and toward the bottom rail 3158. The assembly 3100 also desirably includes a third lift cord 3163 having an upper end secured to first tube 3122*a* and a lower end secured to intermediate rail 3159. The assembly 3100 also desirably includes a fourth lift cord 3165 having an upper end secured to second tube 3122*b* and a lower end secured to bottom rail 3158. In preferred embodiments, an insert rail 3167 is connected with head rail 3102. The insert rail includes eyelets for guiding the lift cords as will be described in more detail below. In highly preferred embodiments, the first guide includes a first cradle 3143 and a first eyelet 3145 extending through the insert rail 3167. The second guide preferably includes a second cradle 3147 and a second eyelet 3149 extending through the insert rail 3167. Thus, the intermediate rail 3159 is coupled with first tube 3122*a* by first lift cord 3134 and third lift cord 3163, and bottom rail 3158 is coupled with second tube 3122*b* by second lift cord 3135 and fourth lift cord 3165. The lift cord arrangement shown in FIG. 50 enables the intermediate rail 3159 and the bottom rail 3158 to move independently of one another. Although the present invention is not limited by any particular theory of operation, it is believed that such independent movement of the intermediate rail and the bottom rail enables selected regions of a window opening to be covered, while other portions remain uncovered. For example, a user may desire to cover a lower portion of a window opening while providing visual access through an upper portion of the window covering.

In certain preferred embodiments, the insert rail 3167 may be secured to an underside of headrail 3102. The assembly 3100 may also include a center support 3169 for securing an end of one of the threadable rods 3124*a* or 3124*b*. The center support 3169 is preferably connected with the headrail 3102. In the particular embodiment shown in FIG. 50, the center support 3169 secures an end of second threaded rod 3124*b*.

The assembly shown in FIG. 50 also includes a third cradle 3197 for rotatably supporting first tube 3122*a* and a fourth cradle 3199 for rotatably supporting second tube 3122*b*. Third lift cord 3163 passes through an opening of third cradle 3197 and fourth lift cord 3165 passes through an opening of fourth cradle 3199. The first and third cradles 3143, 3197 support rotation of first tube 3122*a* and the second and fourth cradles 3147, 3199 support rotation of second tube 3122*b*.

Figure 51A:
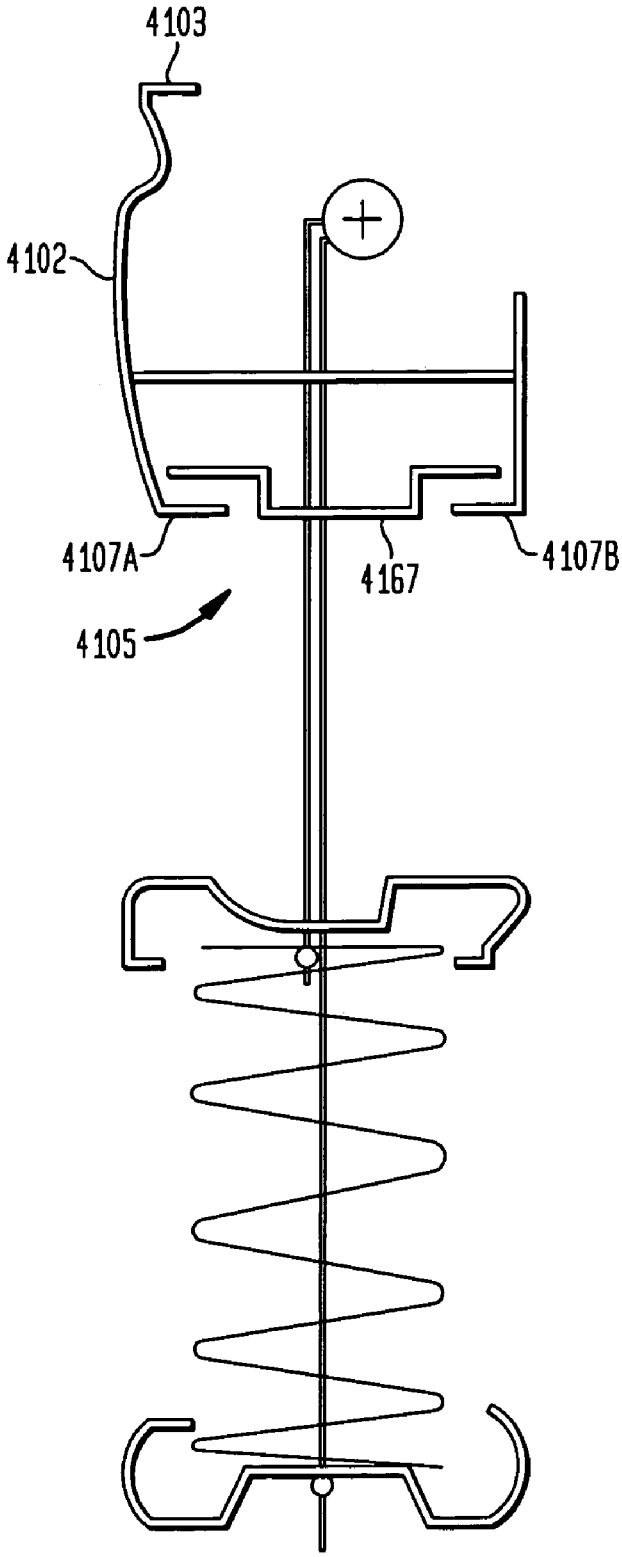
FIG. 51A shows a cross-sectional view of the cordless blind assembly of FIG. 50.

Referring to FIG. 51A, in another preferred embodiment of the present invention, headrail 4102 has a top side 4103 and an underside 4105 having securing flanges 4107*a* and 4107*b*. An insert rail 4167 is secured to an underside of headrail 4102 by securing flanges 4107*a* and 4107*b*. The insert rail 4167 includes eyelets for guiding lift cords as shown and described above.

Figure 51B:
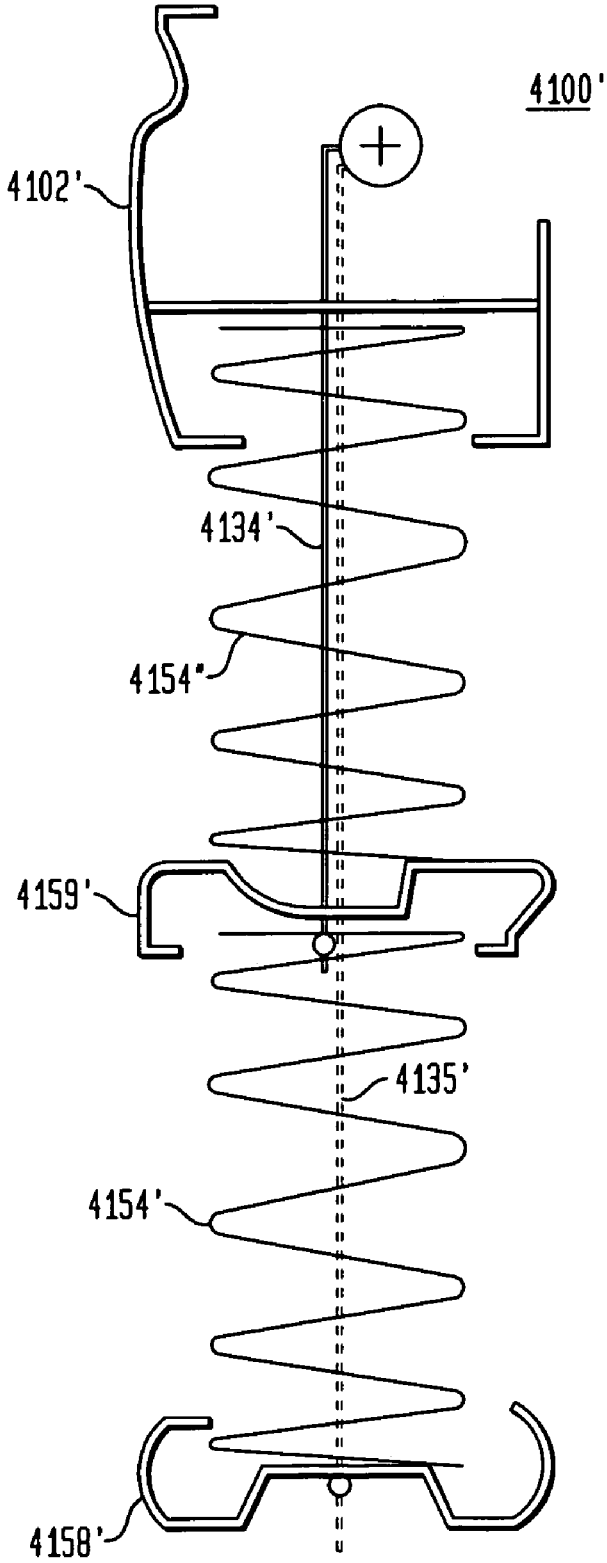
FIG. 51B shows a cordless window blind assembly, in accordance with another preferred embodiment of the present invention.

FIG. 51B shows a cordless window blind assembly 4100' including a headrail 4102', an intermediate rail 4159' suspended below headrail 4102' by first lift cord 4134' and a bottom rail 4158' suspended below headrail 4102' by second lift cord 4135'. The assembly 4100' includes a first window covering material 4154' extending between intermediate rail 4159' and bottom rail 4158', and a second window covering material 4154" extending between headrail 4102' and intermediate rail 4159'. The headrail 4102' has first and second spring motors (not shown) similar to those shown in FIG. 50. The first and second spring motors operate independently of one another so that the intermediate rail 4159' may move independently of bottom rail 4158'. The first and second window covering materials 4154', 4154" may have a different opacity, color and/or texture.

Figure 52:
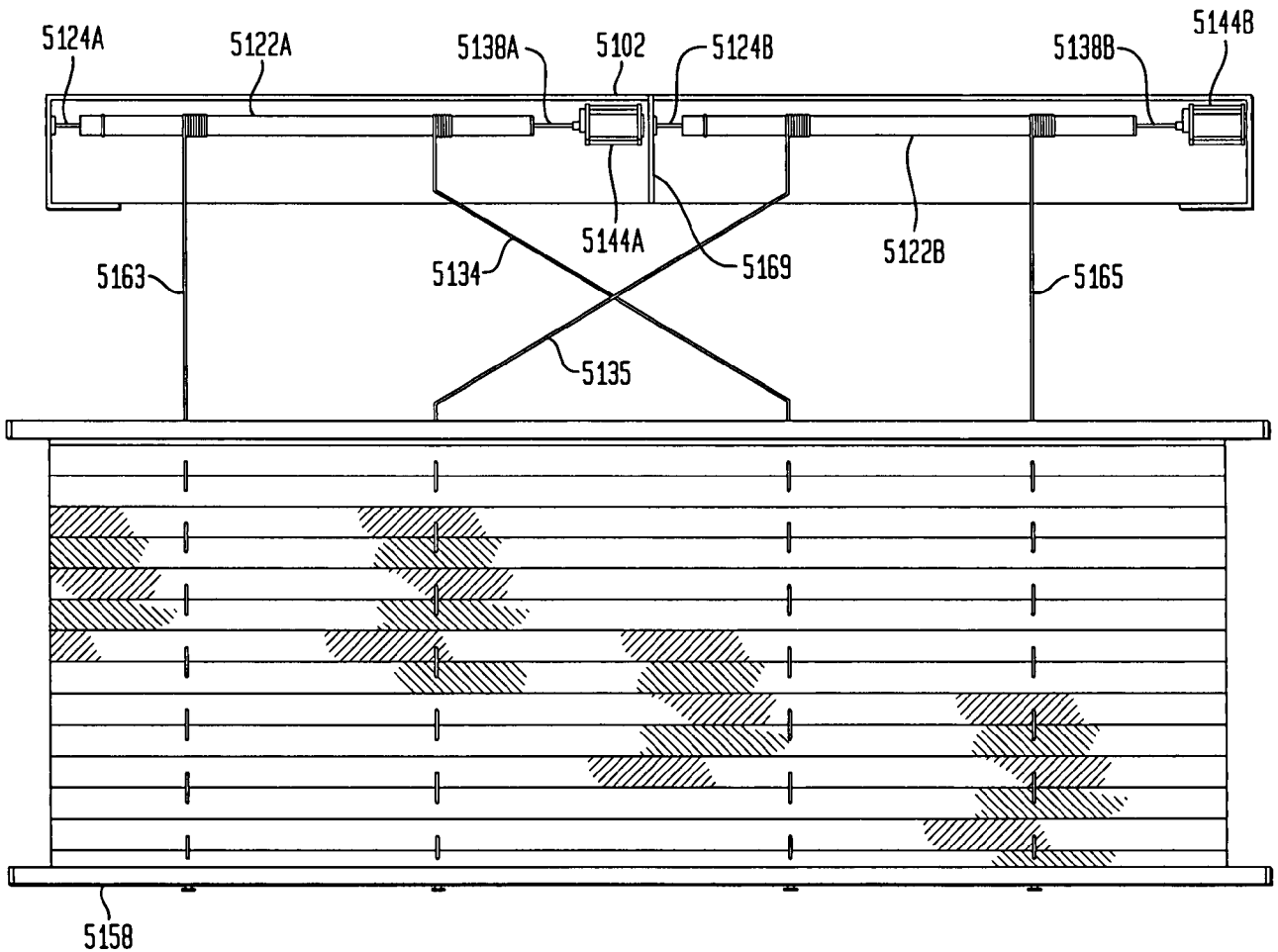
FIG. 52 shows a schematic view of a cordless blind assembly, in accordance with another preferred embodiment of the present invention.

FIG. 52 shows a window blind assembly 5100 including a headrail 5102 having a center support 5169 for dividing the headrail 5102 into first and second compartments. A first compartment includes first tube 5122*a* rotatably mounted therein having a first end threadably coupled to threaded rod 5124*a* and second end coupled with first motor 5144*a* by drive shaft 5138*a*. The second compartment of headrail 5102 includes second tube 5122*b* rotatably mounted therein and threadably coupled to a second threaded rod 5124*b*. The second tube 5122*b* includes a second end coupled with second motor 5144*b* via drive shaft 5138*b*. The assembly 5100 includes a first lift cord 5134 and third lift cord 5163 extending between first tube 5122*a* and bottom rail 5158. The assembly also includes second lift cord 5135 and fourth lift cord 5165 extending between second tube 5122*b* and bottom rail 5158. The first and second lift cords 5134, 5135 cross paths as a result of being guided by openings in support cradles and cord guides attached to the window covering material (not shown). As a result, first lift cord 5155 follows a path including a first leg extending away from first tube 5122*a*, a second leg extending away from first tube 5122*a* and toward second tube 5122*b*, and a third leg extending away from second tube 5122*b* and toward bottom rail 5158. The second lift cord follows a path that includes a first leg extending away from second tube 5122*b*, a second leg extending away from second tube 5122*b* and toward first tube 5122*a*, and a third leg extending away from first tube 5122*a* and toward bottom rail 5158. In preferred embodiments, the third and fourth lift cords 5163, 5165 do not cross one another but extend in a substantially vertical direction from the respective first and second tubes 5122*a* and 5122*b* to bottom rail 5158.

Figure 53:
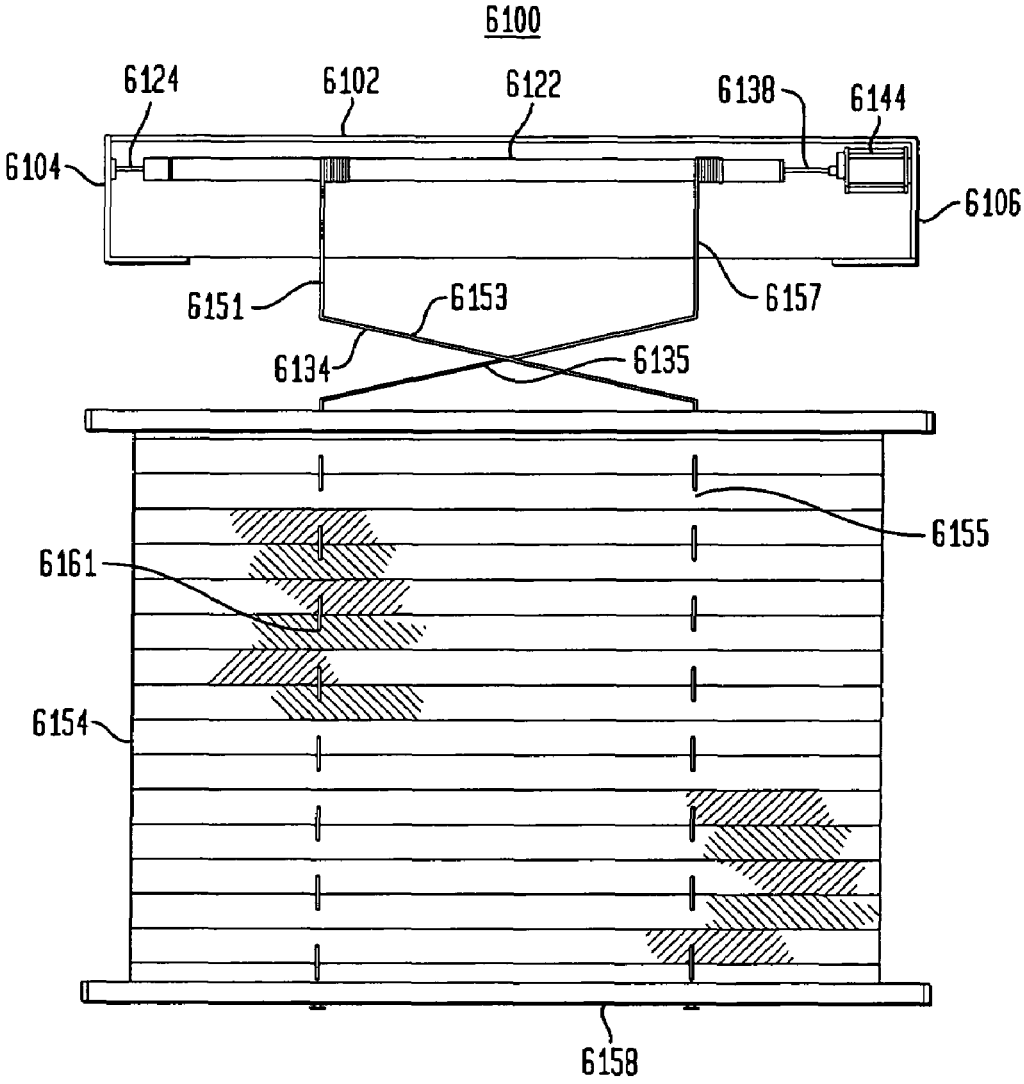
FIG. 53 shows a schematic view of a cordless blind assembly, in accordance with still another preferred embodiment of the present invention.

FIG. 53 shows a window blind assembly 6100, in accordance with still another preferred embodiment of the present invention, including a headrail 6102 and a tube 6122 rotatably mounted within headrail 6102. The headrail 6102 has a first end 6104 and a second end 6106 remote therefrom. A threaded rod 6124 is threadably coupled with the first end of tube 6122 and a motor 6144 is coupled with a second end of tube 6122 by drive shaft 6138. A first lift cord 6134 has an upper end secured to first tube 6122 and a lower end secured to bottom rail 6158. A second lift cord 6135 has an upper end secured to tube 6122 and a lower end secured to bottom rail 6158. The assembly 6100 includes first and second guides (not shown), such as the cradles and cord guides, that result in the first and second lift cords 6134, 6135 crossing each other before the lift cords pass through window covering material 6154. The first guide directs the first lift cord 6134 along a path including a first leg 6151 extending in a generally perpendicular direction relative to the longitudinal axis of headrail 6102, a second leg 6153 extending in a direction generally parallel to the longitudinal axis of headrail 6102 and a third leg 6155 extending in a direction generally perpendicular to the longitudinal axis of headrail 6102. The second guide directs the second lift cord 6135 along a path including a first leg 6157 extending in a generally perpendicular direction relative to the longitudinal axis of headrail 6102, a second leg 6159 extending in a direction generally parallel to the longitudinal axis of headrail 6102 and a third leg 6161 extending in a direction generally perpendicular to the longitudinal axis of headrail 6102.

Figure 54:
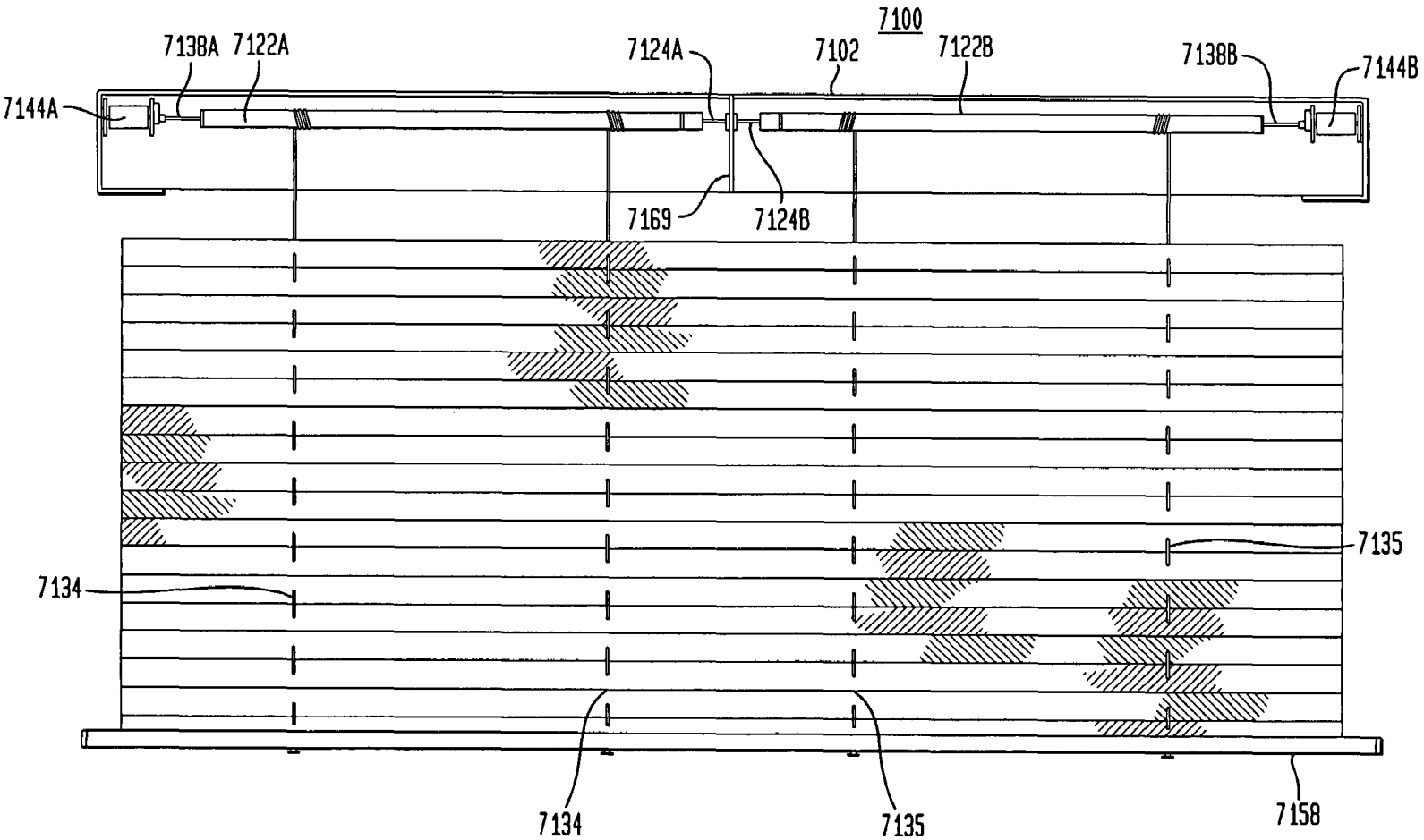
FIG. 54 shows a schematic view of a cordless blind assembly, in accordance with yet another preferred embodiment of the present invention.

FIG. 54 shows a window blind assembly 7100 in accordance with another preferred embodiment of the present invention including a headrail 7102 divided into two compartments by central support 7169. The assembly 7100 includes a first rotatable tube 7122*a* having one end threadably engaged with a threaded rod 7124*a* and a second end coupled with spring motor 7144*a* via drive shaft 7138*a*. The assembly includes a first set of lift cords 7134 having upper ends secured to first tube 7122*a* and lower ends secured to bottom rail 7158. The assembly includes second tube 7122*b* having a first end threadably engaged with threaded rod 7124*b* and a second end coupled with second motor 7144*b* via drive shaft 7138*b*. A second set of lift cords 7135 have upper ends secured to second tube 7122*b* and lower ends secured to bottom rail 7158. The first and second tubes 7122*a* and 7122*b* traverse along the longitudinal axis of the headrail 7102 when rotating.

Figure 55:
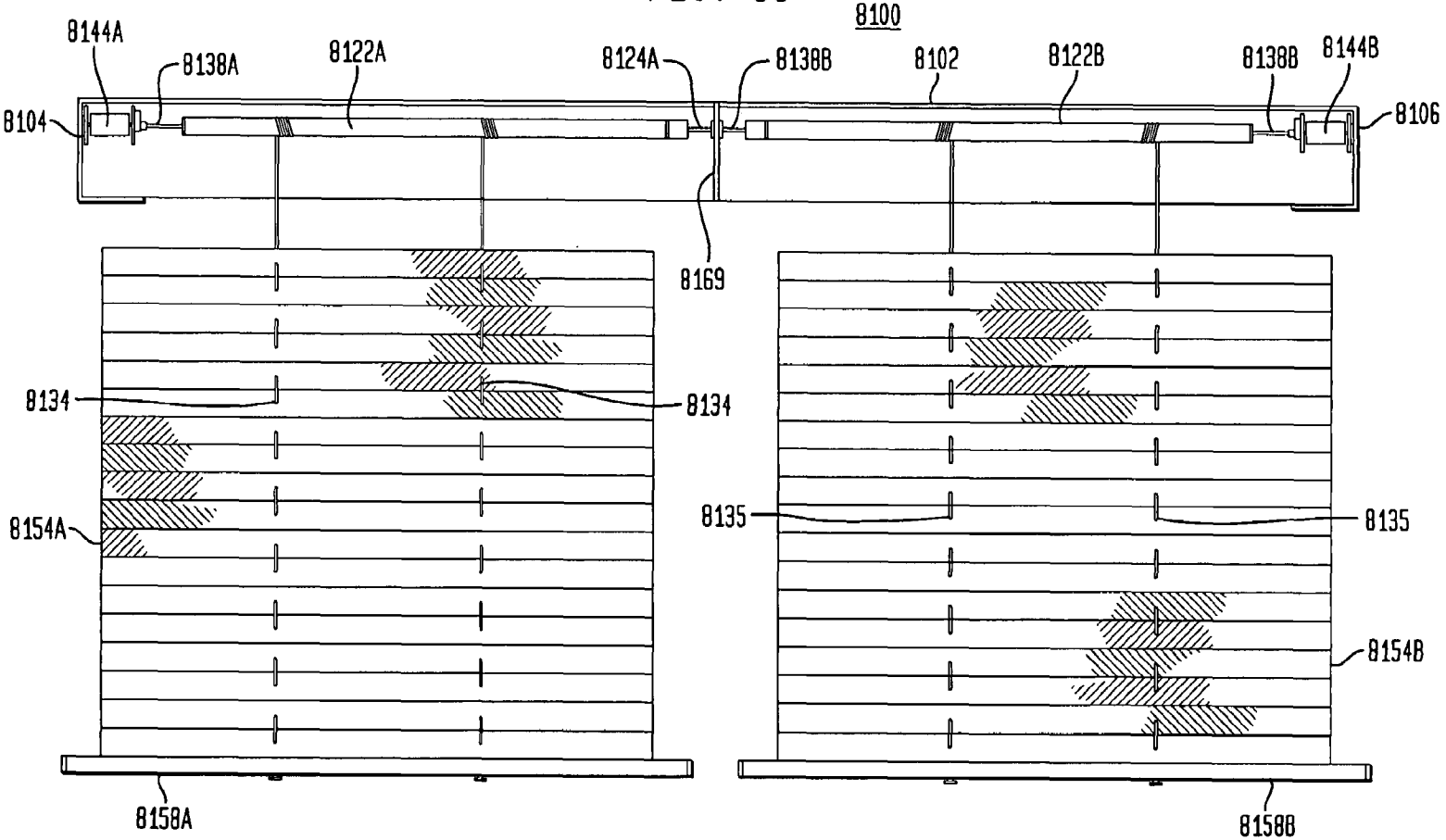
FIG. 55 shows a schematic view of a cordless blind assembly, in accordance with still another preferred embodiment of the present invention.

FIG. 55 shows a window blind assembly 8100 including a first bottom rail 8158*a* and a second bottom rail 8158*b* whereby the two bottom rails may move independently from one another. The assembly 8100 includes a headrail 8102 divided into two compartments by central support 8169. The assembly 8100 includes a first rotatable tube 8122*a* having a first end threadably engaged with threaded rod 8124*a* and a second end coupled with drive motor 8144*a* by drive shaft 8138*a*. The assembly 8100 also includes a second rotatable tube 8122*b* rotatably mounted in a second compartment and threadably engaged at a first end thereof to threaded rod 8138*b*. The second rotatable tube 8122*b* is coupled to motor 8144*b* at a second end thereof by drive shaft 8138*b*. The first and second tubes 8122*a* and 8122*b* operate independently of one another. As the respective tubes rotate, they traverse between first and second ends 8104, 8106 of headrail 8102. The assembly 8100 includes a first set of lift cords 8134 having upper ends secured to first tube 8122*a* and lower ends secured to bottom rail 8158*a*. The assembly 8100 also includes a second set of lift cords 8135 having upper ends secured to second tube 8122*b* and lower ends secured to bottom rail 8158*b*. The arrangement enables the first bottom rail 8158*a* and the second bottom rail 8158*b* to operate independently of one another. The assembly 8100 also includes a first window covering material 8154*a* extending between headrail 8102 and first bottom rail 8154*a* and a second window covering material 8154*b* extending between headrail 8102 and second bottom rail 8158*b*.

Figure 56:
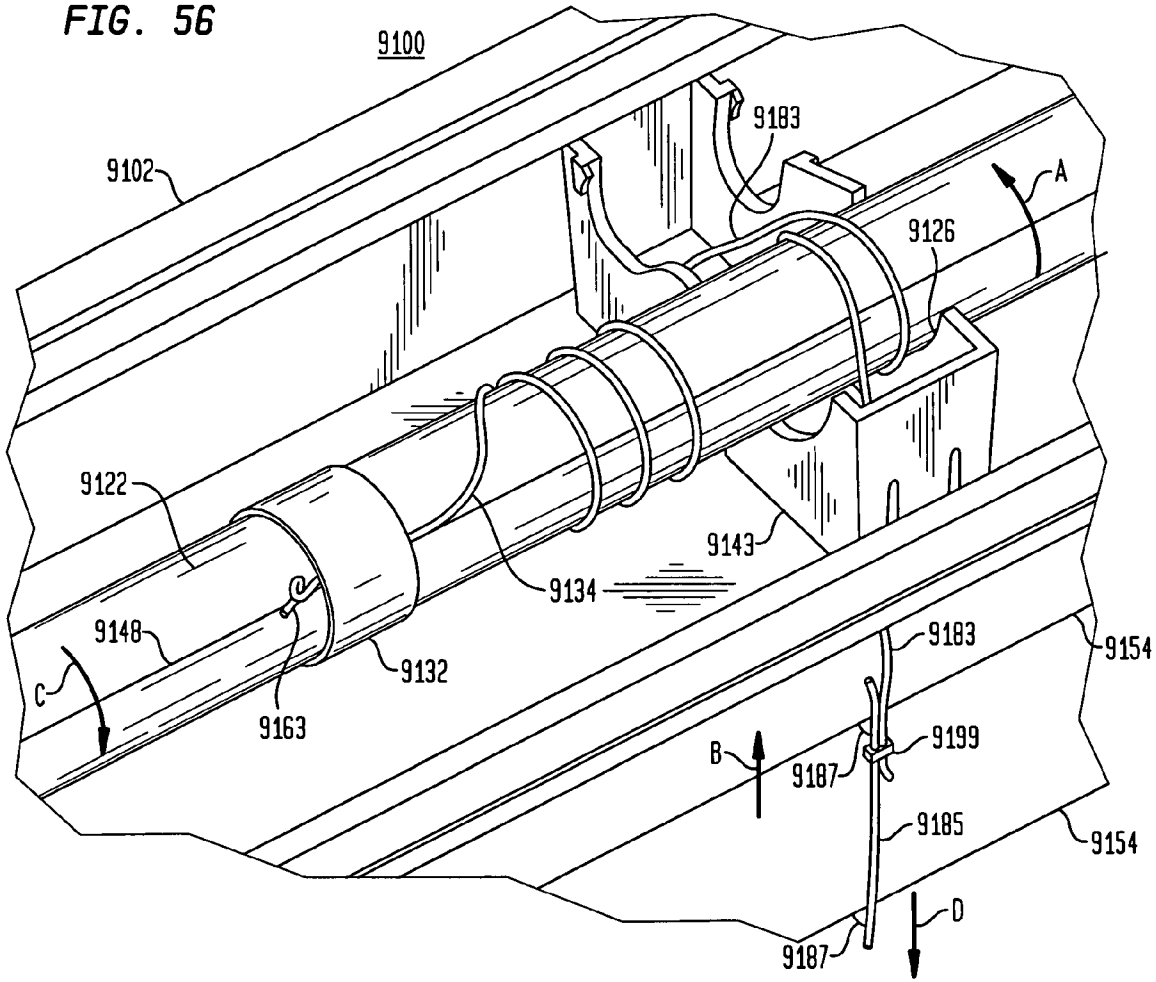
FIG. 56 shows a perspective view of a cordless blind assembly having a combined tilt and lift control, in accordance with certain preferred embodiments of the present invention.
Figure 57A:
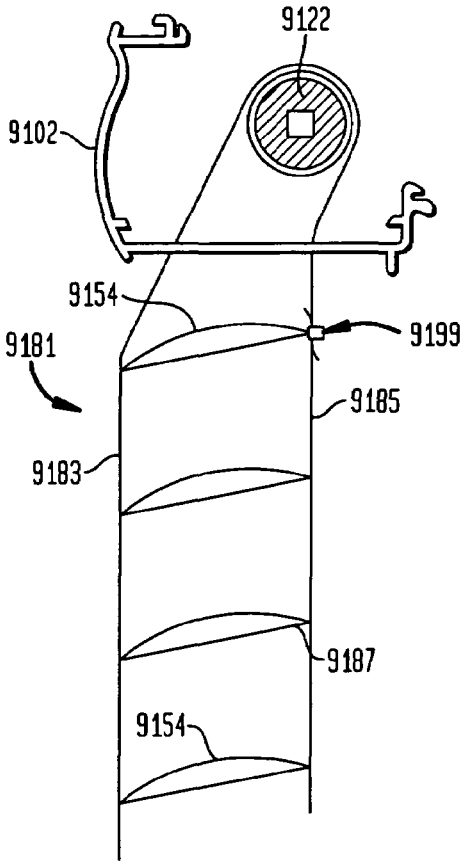
FIG. 57A shows a cross-sectional view of the cordless blind assembly of FIG. 56 including a tilt control device.
Figure 57B:
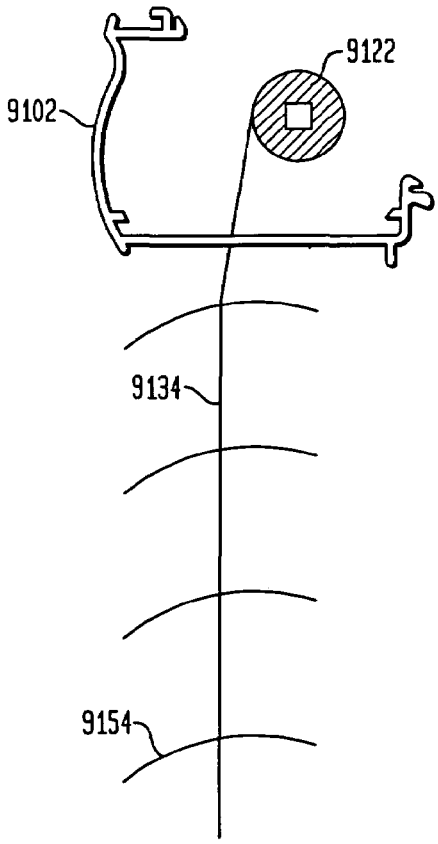
FIG. 57B shows a cross-sectional view of the cordless blind assembly of FIG. 56 including a lift control device.

FIG. 56 shows a perspective view of a cordless window blind assembly 9100 including a head rail 9102 having a cradle 9143 mounted therein. In certain preferred embodiments, the cradle is similar to the cradle 116 shown in FIGS. 23A–23E of the present application. The cradle 9143 includes a bearing surface 9126 for rotatably supporting a tube 9122 disposed in head rail 9102. The rotatable tube 9122 is preferably coupled with a motor, such as a spring motor (not shown). Referring to FIGS. 56, 57A and 57B, a plurality of slats 9154 are suspended below head rail 9102. FIGS. 57A and 57B are simplified views of the structure shown in FIG. 56. Specifically, the cradle 9143 shown in FIG. 56 has been removed from FIGS. 57A and 57B so that the path of the cords wrapped around tube 9122 may be readily seen. In addition, the lift cord 9134 is not shown in FIG. 57A and the ladder tape 9181 is not shown in FIG. 57B. This has been done so that the lift cord and ladder tape may be seen clearly. In actuality, both FIGS. 57A and 57B are combined together to produce the assembly shown in FIG. 56. In an actual device, FIGS. 57A and 57B would overlap one another to show both the lift cord and the ladder tape engaged with rotatable tube 9122. Referring to FIG. 57A, the slats are preferably supported by a ladder tape 9181 including a front ladder cord 9183 suspended below a front section of head rail 9102 and a rear ladder cord 9185 suspended below a rear section of head rail 9102. The ladder tape 9181 also includes a plurality of rungs 9187 extending between the front ladder cord 9183 and the rear ladder cord 9185. The front ladder cord 9183 preferably passes through an opening extending through a bottom of the head rail 9102 and is at least partially wrapped around the tube. The number of times the front ladder cord 9183 is wrapped around the tube depends upon the size and/or weight of the window covering material. Larger window covering materials will require less wrapping of the front ladder cord 9183 around the tube and smaller window covering materials will require more wrapping of the front ladder cord 9183 around the tube. After being at least partially wrapped around the tube, the front ladder cord then exits through another opening in the bottom of head rail 9102 and is connected with an upper end of rear ladder cord 9185. In certain preferred embodiments, the front ladder cord 9183 and the rear ladder cord 9185 are connected by a crimp 9199. In other embodiments, the two ends of the ladder cords 9183, 9185 may be tied together or attached by any other means well known to those skilled in the art. As will be described in more detail below, wrapping the ladder tape 9181 around tube 9122 enables slats 9154 to be rotated between a first closed position and a second closed position. When the bottom rail is pulled down, the slats 9154 preferably rotate from an open position to a first closed position. At that time, further rotation of tube 9122 will result in slippage between the exterior surface of the tube 9122 and the ladder tape 9181, whereby the slats 9154 remain in the first closed position. The slats will continue to remain in the first closed position until the bottom rail is once again lifted toward the headrail. Upon lifting the bottom rail toward the headrail, the slats will rotate approximately 150–180 degrees between the first closed position and a second closed position. Once the slats are in the second closed position, further rotation of tube 9122 will result in slippage between the exterior surface of the tube 9122 and the ladder tape 9181, whereby the slats 9154 remain in the second closed position. Pulling the bottom rail down will rotate the slats from the second closed position to the first closed position.

Figure 58A:
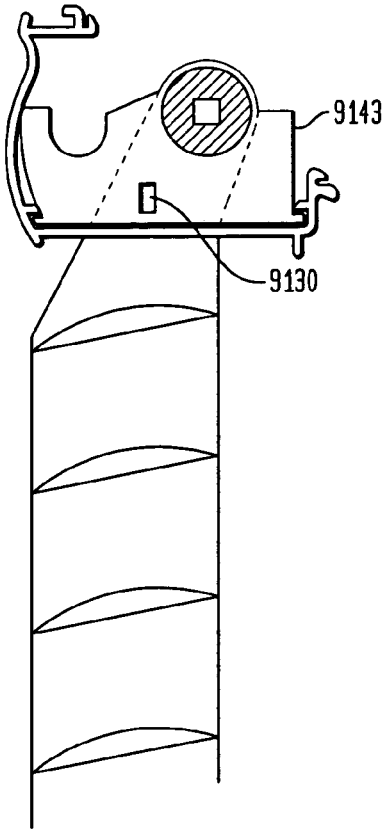
FIG. 58A shows the embodiment of FIG. 57A including a cradle for supporting a rotatable tube.
Figure 58B:
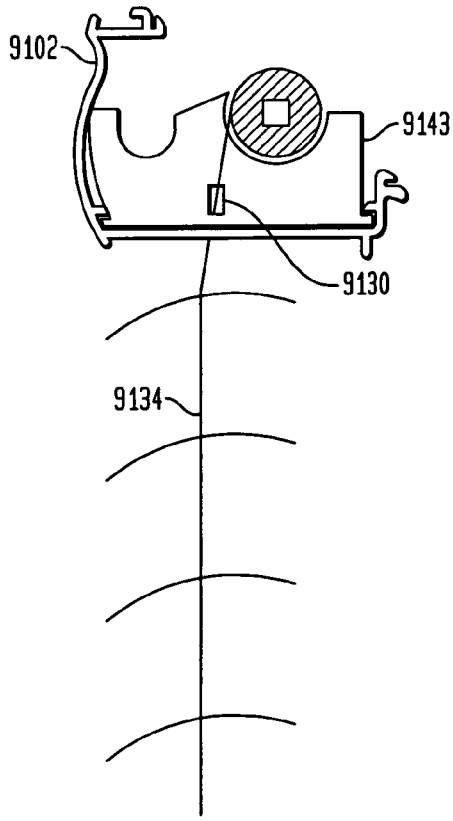
FIG. 58B shows the embodiment of FIG. 57B including a cradle for supporting a rotatable tube.

Referring to FIGS. 56, 58A and 58B, a lift cord 9134 has an upper end 9163 secured within a groove 9148 of tube 9122 by clip 9132. The lift cord 9134 is wrapped around the exterior surface of tube 9122 and then passes through a side opening or window 9130 of cradle 9143. The lift cord 9134 then passes through an opening in the bottom of the cradle 9143 and exits from an underside of head rail 9102. The lower end of the lift cord 9134 is preferably secured to a bottom rail (not shown).

Referring to FIG. 56, when bottom rail is pulled away from the headrail, tube 9122 rotates in a direction indicated by an arrow designated "A" for unwinding lift cord 9134 therefrom. As the lift cord is unwound, the slats are lowered over the window opening. Simultaneously, the front ladder cord 9183 wrapped around the tube 9122 is actuated by the tube so that the rear ladder cord 9185 moves in the direction indicated by arrow "B." As a result, the rungs 9187 of the ladder tape rotate the slats 9154 into a first closed position. Once the slats 9154 are fully rotated into the first closed position, they can rotate no further. As a result, the front ladder cord 9183 begins to slip upon further rotation of the tube 9122. The slats can be moved to an open position by lifting the bottom rail toward the head rail which will rotate the tube in the direction indicated by arrow "C". As the tube rotates in the direction indicated by arrow "C", the lift cord 9134 is wound around the tube 9122. In addition, the ladder cord 9183 will be actuated by the exterior surface of the tube 9122 so as to rotate the slats 9154 first into an open position and then into a second closed position. As the slats are being moved to the second closed position, the rear ladder cord 9185 moves toward the headrail in the direction indicated by the arrow designated "D". After the slats are in the second closed position, the ladder cord begins to slip around the exterior surface of the tube as the lift cord continues to be wound around the tube.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A cordless window blind assembly comprising:

a headrail having a longitudinal axis extending between first and second ends thereof;

a first tube rotatably mounted between the first and second ends of said headrail;

a first motor coupled with said first tube for driving said first tube;

a second tube rotatably mounted between said first tube and the second end of said headrail;

a second motor coupled with said second tube for driving said second tube;

a bottom rail suspended below said headrail;

an intermediate rail suspended below said headrail and positioned between said headrail and said bottom rail;

a window covering material extending between said intermediate rail and said bottom rail;

a first lift cord having an upper end secured to said first tube and a lower end secured to said intermediate rail; and a second lift cord having an upper end secured to said second tube and a lower end secured to said bottom rail, wherein said intermediate rail and said bottom rail are movable independently of one another.

2. The assembly as claimed in claim 1, wherein said window covering material has an upper end attached to said intermediate rail and a lower end attached to said bottom rail.

3. The assembly as claimed in claim 2, further comprising a second window covering material extending between said intermediate rail and said headrail.

4. The assembly as claimed in claim 3, wherein said second window covering material has a different opacity than said first window covering material.

5. The assembly as claimed in claim 1, further comprising:

a first guide coupled with said headrail and adapted to direct said first lift cord through a path including a first leg extending away from said first tube, a second leg extending away from said first tube and toward said second tube, and a third leg extending away from said second tube and toward said intermediate rail; and a second guide coupled with said headrail and adapted to direct said second lift cord through a path including a first leg extending away from said second tube, a second leg extending away from said second tube and toward said first tube, and a third leg extending away from said first tube and toward said bottom rail.

6. The assembly as claimed in claim 5, wherein the first leg of said first lift cord extends in a direction generally perpendicular to the longitudinal axis of said headrail, the second leg of said first lift cord extends in a direction generally parallel to the longitudinal axis of said headrail and the third leg of said first lift cord extends in a direction generally perpendicular to the longitudinal axis of said headrail, and wherein the first leg of said second lift cord extends in a direction generally perpendicular to the longitudinal axis of said headrail, the second leg of said second lift cord extends in a direction generally parallel to the longitudinal axis of said headrail and the third leg of said second lift cord extends in a direction generally perpendicular to the longitudinal axis of said headrail.

7. The assembly as claimed in claim 5, further comprising an insert rail connected to an underside of said headrail, said first guide including a first cradle connected to said headrail for supporting rotation of said first tube, said first cradle being positioned between the first leg and the second leg of said first lift cord path.

8. The assembly as claimed in claim 7, wherein said insert rail includes a first eyelet, and wherein said first guide includes the first eyelet positioned between the second leg and the third leg of the path of said first lift cord.

9. The assembly as claimed in claim 8, wherein said second guide includes a second cradle connected to said headrail for supporting rotation of said second tube, said second cradle being positioned between the first leg and the second leg of the path of said second lift cord.

10. The assembly as claimed in claim 9, wherein said insert rail includes a second eyelet, and wherein said second guide includes the second eyelet positioned between the second leg and the third leg of said second lift cord path.

11. The assembly as claimed in claim 1, further comprising:

a third lift cord having an upper end secured to said first tube and a lower end secured to said intermediate rail; and a fourth lift cord having an upper end secured to said second tube and a lower end secured to said bottom rail.

12. The assembly as claimed in claim 1, further comprising:

a first threaded support rod disposed in said headrail and being threadably coupled with an end of said first tube;

said first motor being a first spring motor disposed in said headrail and being coupled with said first tube for driving said first tube;

a second threaded support rod disposed in said headrail and being threadably coupled with an end of said second tube;

said second motor being a second spring motor disposed in said headrail and being coupled with said second tube for driving said second tube, wherein said first and second tubes traverse between the first and second ends of said headrail when being driven by said respective first and second spring motors.

13. A cordless window blind assembly comprising:

a headrail having a longitudinal axis extending between first and second ends thereof;

a tube rotatably mounted between the first and second ends of said headrail;

a motor coupled with said tube for driving said tube;

a bottom rail suspended below said headrail by first and second lift cords;

an intermediate rail suspended below said headrail and positioned between said headrail and said bottom rail;

a window covering material extending between said intermediate rail and said bottom rail;

a first guide connected to said headrail and being adapted to direct said first lift cord through a path including a first leg extending away from said tube, a second leg extending away from a first end of said tube and toward a second end of said tube, and a third leg extending away from said tube, through said intermediate rail and toward said bottom rail; and a second guide connected to said headrail and being adapted to direct said second lift cord through a path including a first leg extending away from said tube, a second leg extending away from the second end of said tube and toward the first end of said tube, and a third leg extending away from said tube, through said intermediate rail and toward said bottom rail, wherein said intermediate rail and said bottom rail are moveable independent of one another.

14. The assembly as claimed in claim 13, wherein the first leg of said first lift cord extends in a direction generally perpendicular to the longitudinal axis of said headrail, the second leg of said first lift cord extends in a direction generally parallel to the longitudinal axis of said headrail and the third leg of said first lift cord extends in a direction generally perpendicular to the longitudinal axis of said headrail.

15. The assembly as claimed in claim 13, wherein the first leg of said second lift cord extends in a direction generally perpendicular to the longitudinal axis of said headrail, the second leg of said second lift cord extends in a direction generally parallel to the longitudinal axis of said headrail and the third leg of said second lift cord extends in a direction generally perpendicular to the longitudinal axis of said headrail.

16. The assembly as claimed in claim 13, wherein said first lift cord is secured to said tube adjacent the first end of said tube and said second lift cord is secured to said tube adjacent the second end of said tube.

17. The assembly as claimed in claim 13, further comprising a threaded support rod disposed in said headrail adjacent one of the ends of said headrail, said threaded support rod being threadably coupled with one of the ends of said tube.

18. The assembly as claimed in claim 17, wherein said motor is a spring motor disposed in said headrail and being coupled with said tube for driving said tube, wherein said tube traverses between the first and second ends of said headrail when being driven by said spring motor.

19. The assembly as claimed in claim 18, wherein said threaded support rod is disposed adjacent the first end of said headrail and is threadably coupled with the first end of said tube, and wherein said spring motor is disposed adjacent the second end of said headrail and is coupled with the second end of said tube.

20. A window blind assembly comprising:

a headrail having a longitudinal axis extending between first and second ends thereof;

a tube rotatably mounted between the first and second ends of said headrail;

a bottom rail suspended below said headrail;

an intermediate rail suspended below said headrail and positioned between said headrail and said bottom rail;

a window covering material extending between said intermediate rail and said bottom rail;

a lift cord having an upper end secured to said tube and a lower end secured to said intermediate rail.

21. The assembly as claimed in claim 20, further comprising a second window covering material extending between said headrail and said intermediate rail.

22. The assembly as claimed in claim 21, wherein said second window covering material has a different opacity than said first window covering material.

23. The assembly as claimed in claim 20, further comprising:

a second tube rotatably mounted between said first tube and the second end of said headrail;

a second lift cord having an upper end secured to said second tube and a lower end secured to said bottom rail, wherein said first and second tubes rotate independently of one another.

24. The assembly as claimed in claim 23, further comprising:

a first guide connected with said headrail and adapted to direct said first lift cord through a path including a first leg extending away from said first tube, a second leg extending away from said first tube and toward said second tube, and a third leg extending away from said second tube and toward said intermediate rail; and a second guide connected with said headrail and adapted to direct said second lift cord through a path including a first leg extending away from said second tube, a second leg extending away from said second tube and toward said first tube, and a third leg extending away from said first tube and toward said bottom rail.

25. The assembly as claimed in claim 20, wherein said window covering material has an upper end attached to said intermediate rail and a lower end attached to said bottom rail.

26. The assembly as claimed in claim 20, further comprising:

a threaded support rod disposed in said headrail and being threadably coupled with an end of said tube; and a spring motor disposed in said headrail and being coupled with said tube for driving said tube, wherein said tube traverses between the first and second ends of said headrail when being driven by said spring motor.

27. The assembly as claimed in claim 23, further comprising:

a first threaded support rod disposed in said headrail and being threadably coupled with an end of said first tube;

a first spring motor disposed in said headrail and being coupled with said first tube for driving said first tube, wherein said first tube traverses between the first and second ends of said headrail when being driven by said first spring motor, a second threaded support rod disposed in said headrail and being threadably coupled with an end of said second tube;

a second spring motor disposed in said headrail and being coupled with said second tube for driving said second tube, wherein second tube traverses between the first and second ends of said headrail when being driven by said second spring motor.

* * * * *

UNITED STATES PATENT AND TRADEMARK OFFICE

CERTIFICATE OF CORRECTION

PATENT NO. : 7,143,802 B2
APPLICATION NO. : 10/634305
DATED : December 5, 2006
INVENTOR(S) : Toralf H. Strand et al.

It is certified that error appears in the above-identified patent and that said Letters Patent is hereby corrected as shown below:

Column 4, Line 39 “thread ably” should be replaced with --threadably--.
Column 5, Line 22 “square shaped” should be replaced with --square-shaped--.
Column 13, Line 35 “tie off” should be replaced with --tie-off--.
Column 13, Line 48 “tie off” should be replaced with --tie-off--.
Column 14, Line 35 “insert able” should be replaced with --insertable--.
Column 16, Line 4 “helically wound” should be replaced with --helically-wound--.
Column 16, Line 6 insert --108-- after the word “member”.
Column 16, Line 22 “there through” should be replaced with --there-through--.
Column 16, Line 66 “have” should be replaced with --has--.
Column 17, Line 64 “snap fit” should be replaced with --snap-fit--.
Column 21, Line 17 “tie off” should be replaced with --tie-off--.
Column 30, Line 33 insert --said--after the word “wherein”.

Signed and Sealed this

Fourth Day of September, 2007

JON W. DUDAS
*Director of the United States Patent and Trademark Office*